US006053813A

United States Patent [19]

Mathis

[11] Patent Number: 6,053,813

[45] Date of Patent: Apr. 25, 2000

[54] ELECTRONIC GAMING APPARATUS AND METHOD

[76] Inventor: Richard M. Mathis, P.O. Box 1264, Zephyr Cove, Nev. 89448

[21] Appl. No.: 08/949,567

[22] Filed: Oct. 14, 1997

[51] Int. Cl.[7] ..... G07F 17/34; A63F 5/04

[52] U.S. Cl. ..... 463/26; 463/25; 463/20

[58] Field of Search ..... 463/22, 16, 17, 463/18, 19, 20, 21, 25

[56] References Cited

U.S. PATENT DOCUMENTS

| | | | |
|---|---|---|---|
| 4,573,681 | 3/1986 | Okada | 463/21 |
| 4,665,502 | 5/1987 | Kreisner | 463/22 |
| 4,669,731 | 6/1987 | Clarke | 463/20 |
| 4,713,787 | 12/1987 | Rapp | 463/22 |
| 5,157,602 | 10/1992 | Fields et al. | 463/22 |
| 5,178,390 | 1/1993 | Okada | 273/143 R |
| 5,263,716 | 11/1993 | Smyth | 463/21 |
| 5,511,781 | 4/1996 | Wood et al. | 463/25 |
| 5,863,249 | 1/1999 | Inoue | 463/22 |
| 5,871,400 | 2/1999 | Yfantis | 463/22 |

*Primary Examiner*—Jessica J. Harrison
*Attorney, Agent, or Firm*—Adam H. Tachner; Crosby, Heafey, Roach & May

[57] ABSTRACT

A method for operating a microprocessor controlled, reel type slot machine in which payoff is determined before a final game outcome is displayed to a player. A pre-defined count of random numbers is generated and presented to a digital filter having tap outputs which correspond to paytable payline equations. The minimum number of payline equations is equal to the number of distinct paylines in the paytable plus one. Any changes in game outcome are taken into account by modifying variables in computer memory and as such do not require a change in tables stored in computer memory. Several features for attracting players to the apparatus and increasing the enjoyment of playing a game are included.

44 Claims, 17 Drawing Sheets

| | | | | | |
|---|---|---|---|---|---|
| Reel1Pos1 | BLNK | Reel2Pos1 | SP | Reel3Pos1 | BLNK |
| Reel1Pos2 | CH | Reel2Pos2 | BLNK | Reel3Pos2 | 5BAR |
| Reel1Pos3 | BLNK | Reel2Pos3 | CH | Reel3Pos3 | BLNK |
| Reel1Pos4 | BAR | Reel2Pos4 | BLNK | Reel3Pos4 | SP |
| Reel1Pos5 | BLNK | Reel2Pos5 | BAR | Reel3Pos5 | BLNK |
| Reel1Pos6 | 5BAR | Reel2Pos6 | BLNK | Reel3Pos6 | CH |
| Reel1Pos7 | BLNK | Reel2Pos7 | 5BAR | Reel3Pos7 | BLNK |
| Reel1Pos8 | SP | Reel2Pos8 | BLNK | Reel3Pos8 | BAR |
| Reel1Pos9 | BLNK | Reel2Pos9 | SP | Reel3Pos9 | BLNK |
| Reel1Pos10 | CH | Reel2Pos10 | BLNK | Reel3Pos10 | 5BAR |
| Reel1Pos11 | BLNK | Reel2Pos11 | CH | Reel3Pos11 | BLNK |
| Reel1Pos12 | BAR | Reel2Pos12 | BLNK | Reel3Pos12 | SP |
| Reel1Pos13 | BLNK | Reel2Pos13 | BAR | Reel3Pos13 | BLNK |
| Reel1Pos14 | 5BAR | Reel2Pos14 | BLNK | Reel3Pos14 | CH |
| Reel1Pos15 | BLNK | Reel2Pos15 | 5BAR | Reel3Pos15 | BLNK |
| Reel1Pos16 | SP | Reel2Pos16 | BLNK | Reel3Pos16 | BAR |
| 4 | | 3 | | 2 | |

FIG. 4

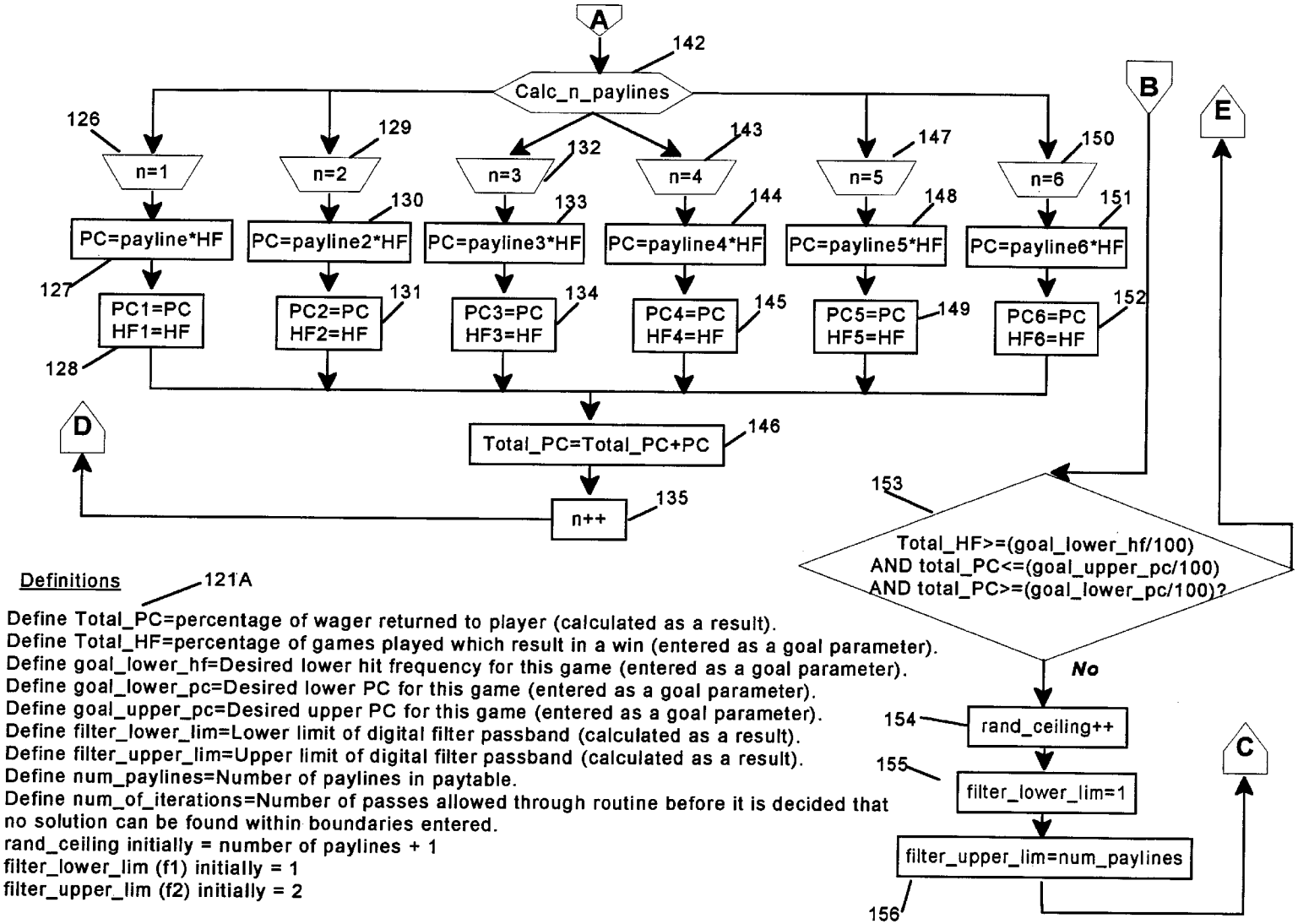

Definitions 121A

Define Total_PC=percentage of wager returned to player (calculated as a result).
Define Total_HF=percentage of games played which result in a win (entered as a goal parameter).
Define goal_lower_hf=Desired lower hit frequency for this game (entered as a goal parameter).
Define goal_lower_pc=Desired lower PC for this game (entered as a goal parameter).
Define goal_upper_pc=Desired upper PC for this game (entered as a goal parameter).
Define filter_lower_lim=Lower limit of digital filter passband (calculated as a result).
Define filter_upper_lim=Upper limit of digital filter passband (calculated as a result).
Define num_paylines=Number of paylines in paytable.
Define num_of_iterations=Number of passes allowed through routine before it is decided that no solution can be found within boundaries entered.
rand_ceiling initially = number of paylines + 1
filter_lower_lim (f1) initially = 1
filter_upper_lim (f2) initially = 2

FIG. 7A

ELECTRONIC GAMING APPARATUS AND METHOD

BACKGROUND OF THE INVENTION

1. Field of the Invention

The invention relates to gaming apparatus and more particularly to the class of gaming apparatus known as slot machines wherein wheels having indicia on the periphery are set into rotation at the beginning of the game and which stop at locations indicating a winning or losing combination of the indicia. Gaming apparatus of this type are not limited to spinning reels as an indicator, however, since a video monitor or other display device may be employed to indicate outcome of a game to a player.

2. Background Art

The original slot machines employed mechanically controlled reels set into motion by a player actuating a mechanical arm or lever. The reels were stopped by an indexing wheel having a plurality of grooves into which were thrust a pin which was driven by a random mechanical actuator. Pay out for a winning game was made upon the basis of the depth of the groove on the reel into which the pin had entered when the reel was stopped. Ensuing developments in the art employed electrical stopping means and electronic methods of determining the angular position the reels when stopped. The most recent of reel machines use a stepper motor to drive each reel into rotation and to stop each reel at a predetermined position to indicate the outcome of the game to the player.

In the original mechanically actuated gaming apparatus the starting and stopping of the reel rotation was assumed to be substantially in a random fashion in accordance with the driving of the mechanical actuator by the player. The pay out after the reels were stopped was in accordance with the angular position of the physical reel in relation to a payline which is a fixed point indicated to the player in by means of a line or other means fixed in relation to the reels. Some apparatus incorporated multiple paylines the number of which was selected in accordance with the amount of the wager according to a pay schedule prior to initiating the game. Multiple payline apparatus are generally known as "multi-line games". The pay out odds and the amount paid out was controlled by means of the number of symbols on the physical reel and the combinations indicated to the player on an award schedule. In order to allow the operator of the game to realize a profit upon its operation, the amount returned to players by the apparatus over a large number of plays must be a percentage less than 100% of the total amount wagered over the large number of games played. The lowest probability of a win is a function of the number of reels (n) and the number of allowed stop positions on each reel (S) which is equal to $S^n$. The parameters which may be adjusted to allow profitability with pay are the number of reels, the number of stop positions, the definition of a winning combination and the amount paid upon a winning combination. All of these must be in a proper proportion and small enough number as to not confuse the player and provide him with playing enjoyment in order to induce him to play the game. A configuration in which there are more than four reels or more physical symbol positions (stops) on the reel than 24 have been proven to be detrimental to attracting and holding the attention of a player. If the chance to hit the largest pay shown on the award schedule is the same with each game played and only one combination of symbols shown on the reels results in award of this pay, the chance that this will occur in a 4 reel 24 stop machine is 1 time in 331,776 games. This results in a severe restriction on the amount of the largest pay which can be offered by the operator and still allow his operation to remain profitable.

In later developments, Telnaes U.S. Pat. No. 4,448,419 describes a gaming apparatus in which there are a greater number of "virtual" stop positions in computer memory than physical stop positions on the physical reel. There is an actual physical symbol on each reel corresponding to each virtual position in memory, but there are a greater number of virtual positions in memory than there are physical stops on the reel. A random number generator is used to select a number corresponding to a virtual position for each reel. Since there are more virtual positions in memory than physical stops on the reel, the probability of not selecting a winning symbol within a rotation of the reels for a particular game can be increased greatly over that of the game whose outcome depended only upon physical stops. Using the same four reel game as described in the previous paragraph, but with a 72 position virtual reel gives a one in 26,873,856 chance of hitting the largest pay shown under the same conditions. This apparatus also allows the odds to be changed by varying the number of virtual stop positions in memory without physically changing the reels and symbols upon the reels. Since the outcome of a game depends entirely upon the combinations allowed by the virtual stop positions in memory, there is a certain finite step amount in adjustment of the win probability and thus a relatively laborious calculation results in predicting the odds allowed by a game developed using this method.

In a subsequent development, Mathis/Michaelson U.S. Pat. No. 5,380,008 describe an apparatus in which two random numbers are generated, the first to determine if the game is a winner or a loser and the second to determine the amount of pay to return to a player if the game is a winner. Hit frequency is defined as the probability of any win occurring in a game or percentage of winning games of total games played.

In many of the modern gaming apparatus, there is the ability to generate a random pay amount generally known as a "mystery pay". This increases player enjoyment by paying a random amount of coins at a randomly determined point distributed over a number of games. The player is not generally provided with a way of predicting when the mystery pay will occur and may lose interest in waiting for a mystery pay.

SUMMARY OF THE INVENTION

Accordingly, there is an existing need for, and it is an object of the invention to provide, a gaming apparatus wherein the playing enjoyment is enhanced by means of indicating to a player that a guaranteed "bonus" pay in addition to that shown on the game award schedule is impending and to further correlate this bonus pay to the amount of consecutive wins or to the amount of consecutive losses, with notification to the player of amount of wins or losses required to win the bonus pay.

The present invention provides a method for randomly selecting payoff levels in electronic slot machines in which a count of random numbers passing a digital filter tap during a game play are combined in a manner predetermined prior to playing of the game and which are used to select a pay amount equation for purpose of displaying game outcome to a player. The minimum number of pay amount equations is the number of distinct pay awards made by the machine plus one, where the added one represents a losing pay amount equation. The theoretical frequency of winning games occurring and the theoretical amount of a player's wager returned to him can be changed within a given game structure (pay table) by means of changing pay amount equations or by changing digital filter parameters, count of random numbers presented to the digital filter prior to determining game outcome or range of random numbers presented to the digital filter prior to determining game outcome. None of the aforesaid changes would change the length of a table previously stored in computer memory and as such result in efficient use of computer memory and allow rapid dynamic changes should these changes be required and desirable as determined by an operator of a machine.

It is therefore another object of the invention to provide a gaming apparatus wherein the ability to assign to each line of a multi-line game a separate hit frequency is provided. This can be done by adjustment of feedforward to various filter taps. The value of this is primarily in satisfying jurisdictional regulations. There is a regulatory acceptance advantage of this technique over payoff determination techniques disclosed in U.S. Pat. Nos. 5,380,008 and 5,456,465.

Another advantage of the present invention is that security is enhanced over the algorithm disclosed in U.S. Pat. No. 4,448,419 since the floor and ceiling of the digital filter passband can be shifted by adding the same constant to each one. The outcome of the game is not affected by this, but if a stream of predetermined numbers is introduced onto the computer data bus by someone attempting to cheat a gaming machine, the numbers have a high probability of not falling within the passband of the digital filter if the passband of the digital filter is shifted randomly as previously described. Indeed, all constants may be varied as there are many solutions to the equation.

Yet another advantage over the algorithm of U.S. Pat. No. 4,448,419 is that the constants which determine game outcome can be easily calculated by a microprocessor which is used to control the gaming machine. This allows an operator of the gaming device to present to the microprocessor desired values for P.C. and game hit frequency and to allow the microprocessor to calculate and use the new constants just calculated.

Still another advantage of the present invention is that any game payoff changes are simply taken into account by modification of the variables described as affecting the game outcome and these do not require table space in computer memory. This provides a far more efficient use of computer processing power than disclosed previously.

Still another advantage of the invention is that game can be designed to allow play in a sequential fashion dependent upon what has occurred previously, even though the game has not been terminated and the results stored. This advantage is of special importance in gaming jurisdictions which do not allow the results of a present game to depend upon a game outcome of a game which was previously played and the results stored.

A still additional advantage of the present invention is the weighting of hit frequency enabling control of volatility (size of variance of PC) of a by means of multiplication of the outcome of the results of filter taps.

Moreover, the present invention may be applied to video games.

The present invention is distinct from a Keno game. In Keno, numbers are drawn without replacement and no use of feedforward or feedback techniques is used to shape probability and frequency of payoff (win) or game volatility. A random number exactly corresponds to a ball in Keno. The decision as to win or lose as described here is determined by the count of random numbers passing through the digital filter and in some cases upon the count of random numbers passing a filter tap. The count passing a filter tap determines a winner and the amount of win for the present invention, unlike the known Keno game.

The present invention may be allowed in some gaming jurisdictions as a semi-skill game for which there is a heavy market demand for skill-dependent games as a substitute for no-skill games.

Yet another advantage of the invention presented here is that it may be allowed in some gaming jurisdictions which allow only lottery games now, such as California. This may be due to the perceived similarity to Keno, though as mentioned before, this is not necessarily true. The game may, however, be made as much like Keno as is required. A huge marketing advantage results if this is true.

This method of solving a pay table equation to obtain the player display results in a very efficient usage of computer memory since no long tables of winning and losing combinations must be predetermined and kept. It also results in a one to one correspondence of symbols displayed to the player as the outcome of a game and those on the physical reel strip. Also, the results of a game cannot be shown to a player until all random numbers (the total quantity) constituting a game have been generated and input to the digital filter AND the results of the pay table equations have been calculated to determine the reel positions to be shown.

Unique games such as those illustrated in FIG. 9 and FIG. 11 are disclosed which employ the present invention to create a game which is entertaining to a player and which is not realized if the present art is employed.

A game entertaining to a player is illustrated in FIG. 1 in which a display which indicates count of sequential losing games is employed to indicate proximity of a "mystery pay".

Briefly stated, a method for operating a microprocessor controlled, reel type slot machine is provided in which payoff is determined before a final game outcome is displayed to a player. A pre-defined count of random numbers is generated and presented to a digital filter having tap outputs which correspond to pay table payline equations. The minimum number of payline equations is equal to the number of distinct paylines in the pay table plus one. Any changes in game outcome are taken into account by modifying variables in computer memory and as such do not require a change in tables stored in computer memory. Several features for attracting players to the apparatus and increasing the enjoyment of playing a game are included.

A feature of the invention includes a method of operating a game machine having a display area, the method including the steps of randomly generating a number within a first predetermined range of numbers, determining whether the random number is within a second predetermined range of numbers, the second predetermined range of numbers being a subset of the first predetermined range of numbers, and displaying a winning symbol within the display area if the random number is within the second predetermined range of numbers.

Another feature of the invention includes a method of operating a game machine having a display area, the method including the steps of setting a count of randomly generated numbers to zero at the beginning of a gaming period, randomly generating a number within a first predetermined range of numbers, incrementing the count after generating the random number, determining whether the random number is within a second predetermined range of numbers, the second predetermined range of numbers being a subset of the first predetermined range of numbers, determining whether the count is equal to a predetermined count limit, displaying a winning symbol within the display area if the random number is within the second predetermined range of numbers and the count is equal to the predetermined count limit, and permitting a game player to increase a wager if the random number is within the second predetermined range of numbers and the count is less than the predetermined count limit.

Yet another feature of the invention includes a method of operating a game machine having a display area, the method including the steps of setting a count of randomly generated numbers to zero at the beginning of a gaming period, determining the amount of a wager made by a game player, randomly generating a number within a first predetermined range of numbers, incrementing the count after generating the random number, determining whether the random number is within a second predetermined range of numbers, the second predetermined range of numbers being a subset of the first predetermined range of numbers, incrementing a hit value if the random number is within the second predetermined range of numbers, determining whether the count is equal to a predetermined count limit, and displaying a winning symbol within the display area if the random number is within the second predetermined range of numbers and the count is equal to the predetermined count limit, the winning symbol being derived from the hit value and the wager amount.

A further feature of the invention includes a game apparatus including a random number circuit for generating a random number signal within a first bandwidth, a digital filter circuit electrically connected to the random number circuit such that the digital filter circuit passes the random number signal if the random number signal is within a second bandwidth, and an output device electrically connected to the digital filter circuit such that the output device displays a winning symbol in response to the digital filter circuit passing the random number signal.

Yet a further feature of the invention includes a game apparatus including a random number circuit for generating a plurality of random number signals within a first bandwidth, a counter circuit electrically connected to the random number circuit such that the counter circuit increments a count value each time the random number circuit generates one of the plurality of random number signals, a digital filter circuit electrically connected to the random number circuit such that the digital filter circuit passes a portion of the plurality of random number signals that are within a second bandwidth, and an output device electrically connected to the digital filter circuit such that the output device displays a winning symbol in response to the count value being equal to a predetermined count value and the digital filter circuit passing the portion of the plurality of random number signals.

Yet another feature of the present invention is that either of the first or second predetermined ranges of numbers, or the bandwidths these ranges represent, may be randomly generated.

BRIEF DESCRIPTION OF THE DRAWINGS

The particular features and advantages of the invention as well as other objects will become apparent from the following description along with the accompanying drawings in which:

FIG. 4 is an illustration of three reel "strips" which contain symbols at the physical symbol stop positions of each reel and which indicate the shifted positions of the reels for the purpose of illustration of the method of payoff determination.

FIGS. 7 and 7A are a computer flow diagram illustrating a method for determining digital filter parameters, random number range and count of random numbers for a single line game illustrated in Table 1.

DETAILED DESCRIPTION OF A PREFERRED EMBODIMENT

Figure 1:
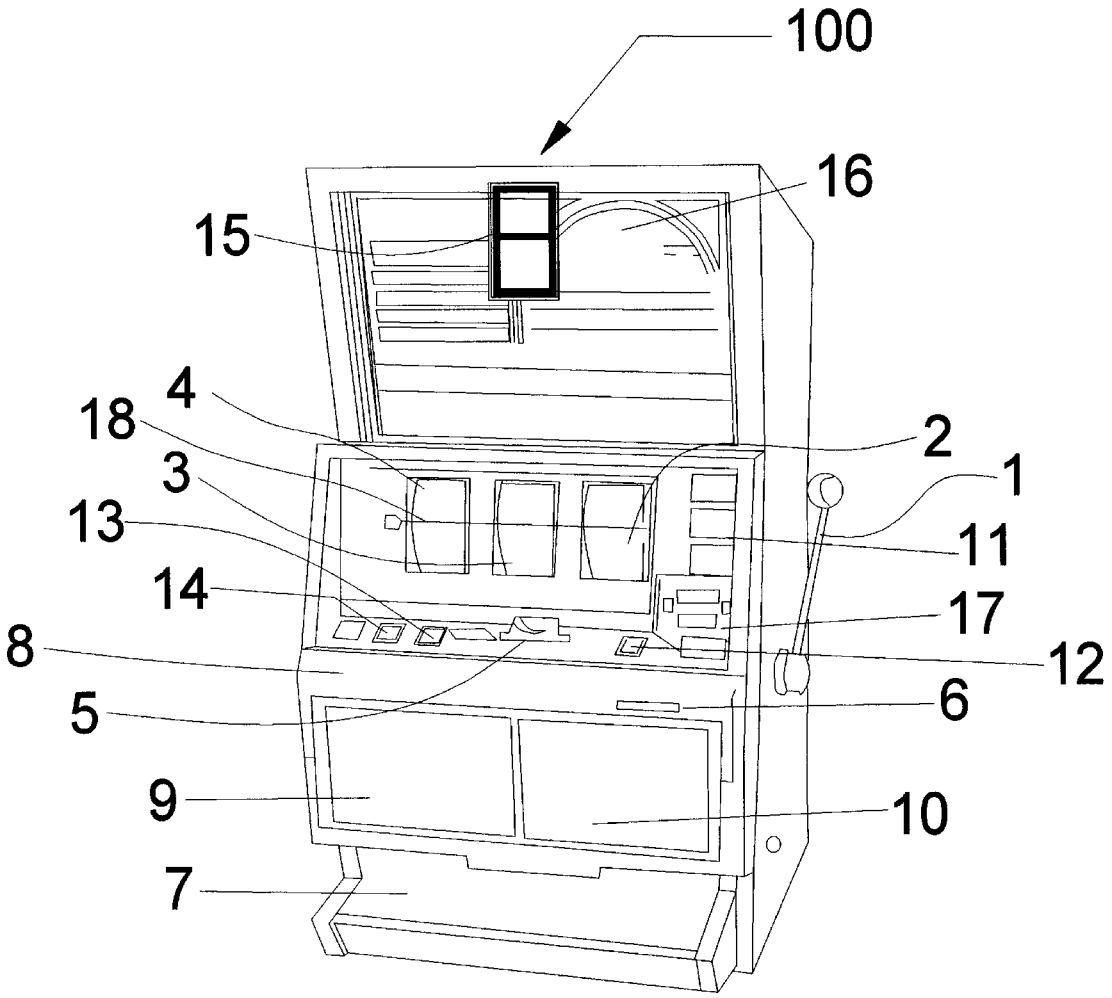
FIG. 1 is a diagrammatic perspective representation of a reel type gaming apparatus within which the present invention preferably is embodied.

Referring to the accompanying figures, it will be seen that FIG. 1 represents a preferred form of gaming apparatus 100 incorporating the principles of the present invention. The apparatus is of the well known gaming apparatus variety known as a slot machine which includes a handle 1, a coin slot 12, generally three or more reels 2–4, play buttons 12–14 and a tray 7 into which are dispensed awards made to a player upon conclusion of a winning game (the payoff). Each reel includes a set of symbols employed to display an outcome of a game which is played on the slot machine 100. In the embodiment illustrated, slot machine 100 has three reels 2, 3, 4 and affixed to the reels are reel strips illustrated in FIG. 3. Each of the reel strips illustrated in FIG. 3 has 16 physical stop positions. Symbols which appear beneath payline 18 after the reels are stopped show the results of a game to a player. The game outcome may be as shown on pay table 16 included in the slot machine, alternatively illustrated in Table 1. Generally and conventionally, only combinations of symbols which may appear beneath a payline and which will result in a winning game and an award to a player are listed on pay table 16; all other combinations displayed to a player indicate a losing game. A slot machine can incorporate any number of reels which may include any number of stop positions. The stop positions may utilize any system of symbols. A system of symbols for a game does not have to include a "blank" (no symbol indicated) position provided that a pay table included in the slot machine which includes such a game provides a method for indicating a losing game by excluding losing combinations of symbols.

Figure 3:
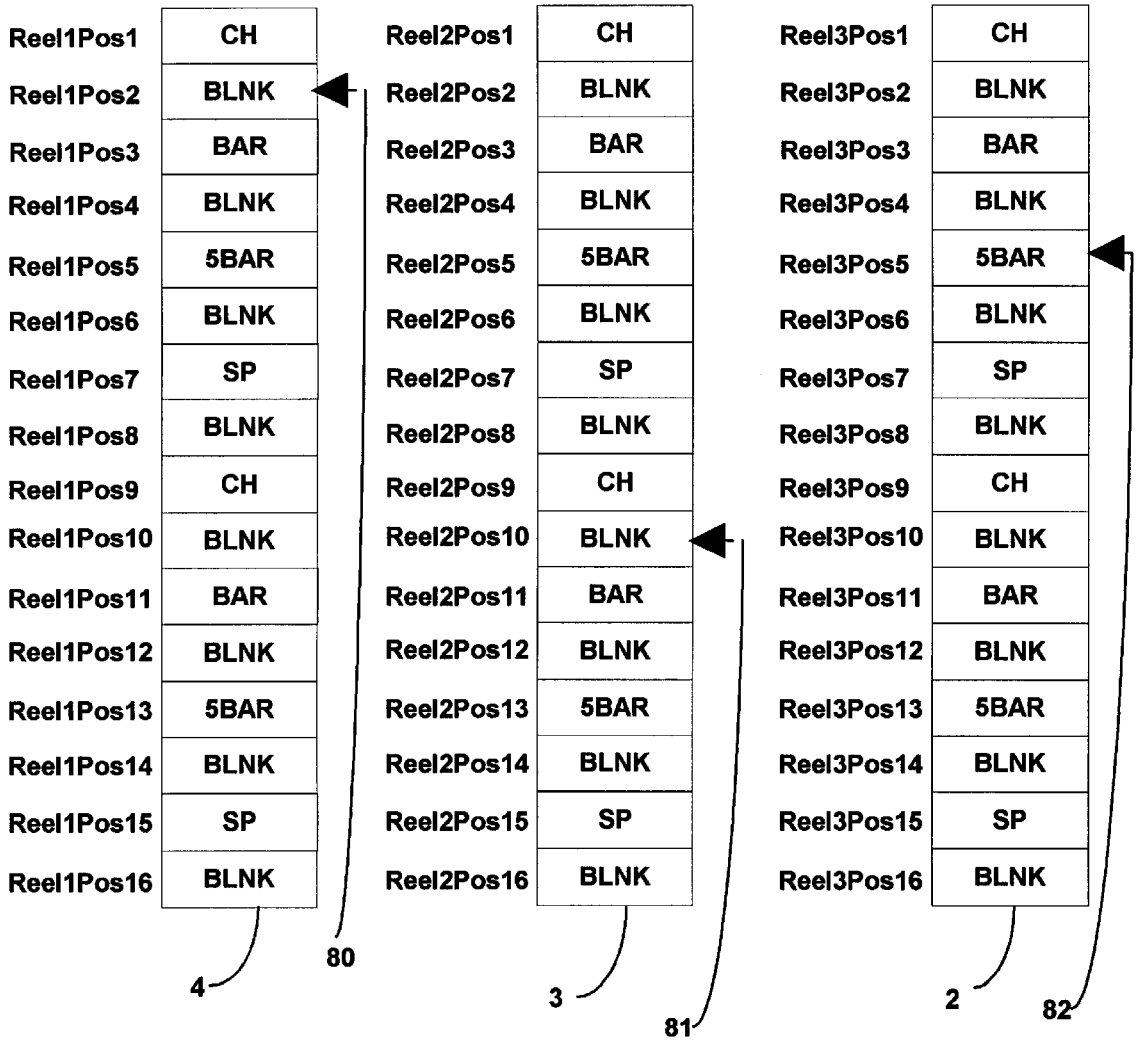
FIG. 3 is an illustration of three reel "strips" which contain symbols at the physical symbol stop positions of each reel and which indicate the initial positions of the reels for the purpose of illustration of the pay method and apparatus of the present invention.

Three typical reel "strips" are illustrated in FIG. 3. The reel strips are secured circumferentially to reels 2–4. In a preferred embodiment illustrated in FIG. 3, each reel is assigned 16 physical stop positions, the stop positions corresponding to each symbol on a reel strip attached thereto; one symbol on the reel strip is located at each physical stop position of the reel to which the reel strip is attached. In the embodiment illustrated in FIG. 3, the symbol pattern on each reel strip is the same and displays (beginning from top of the illustration) "Cherry", "Blank", "Bar", "Blank", "5Bar", "Blank", "Special Symbol", "Blank", "Cherry", "Blank", "Bar", "Blank", "5Bar", "Blank", "Special Symbol", "Blank" as each reel rotates through its sixteen physical stop positions. Many variations of symbols and number of symbols on a reel strip are possible.

Figure 2:
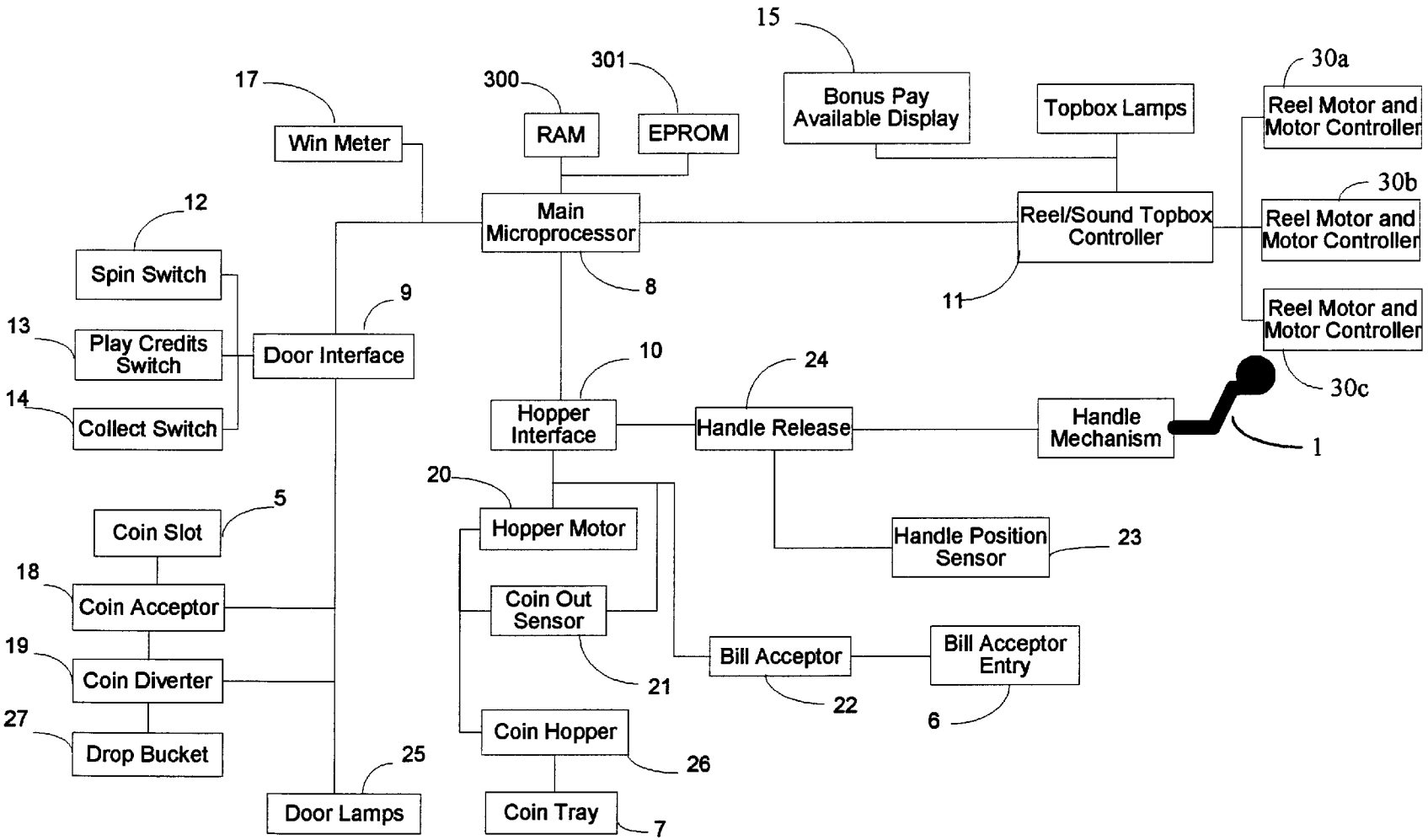
FIG. 2 is a block diagram of the gaming apparatus control system incorporating the invention.

FIG. 2 is a block diagram of components which may be employed for construction and implementation of the present invention. A player inserts a coin into coin slot 5. The coin is validated by coin acceptor 18. An electrical signal indicating that a valid coin has been accepted is transmitted to a main microprocessor 8 which waits for indication that the player desires to insert more coins or that the player desires to play a game. The player indicates that he desires to play a game by actuating a handle 1 or by actuating a spin switch 12. The handle or spin switch transmit an electrical signal to the microprocessor which rotates the reels 2–4 by means of reel motors and motor controller 30*a*–30*c*. Rotational position of each reel relative to the payline 18 is determined by open loop control or closed loop control techniques well known to those skilled in the art to which the invention pertains. Results of a game are indicated to a player by means of stopping reels to display a combination of symbols beneath the payline in accordance with a combination calculated by means of a payline equation selected using the method and system illustrated in FIG. 5 in accordance with game results. If results of the game indicate a winning game, the microprocessor transmits an electrical signal to a coin dispensing device 26 which dispenses a number of coins, where the number corresponds to the combination of symbols appearing beneath the payline 18. The combination of symbols corresponds to a combination of symbols appearing on a line of the pay table 16.

Figure 7:
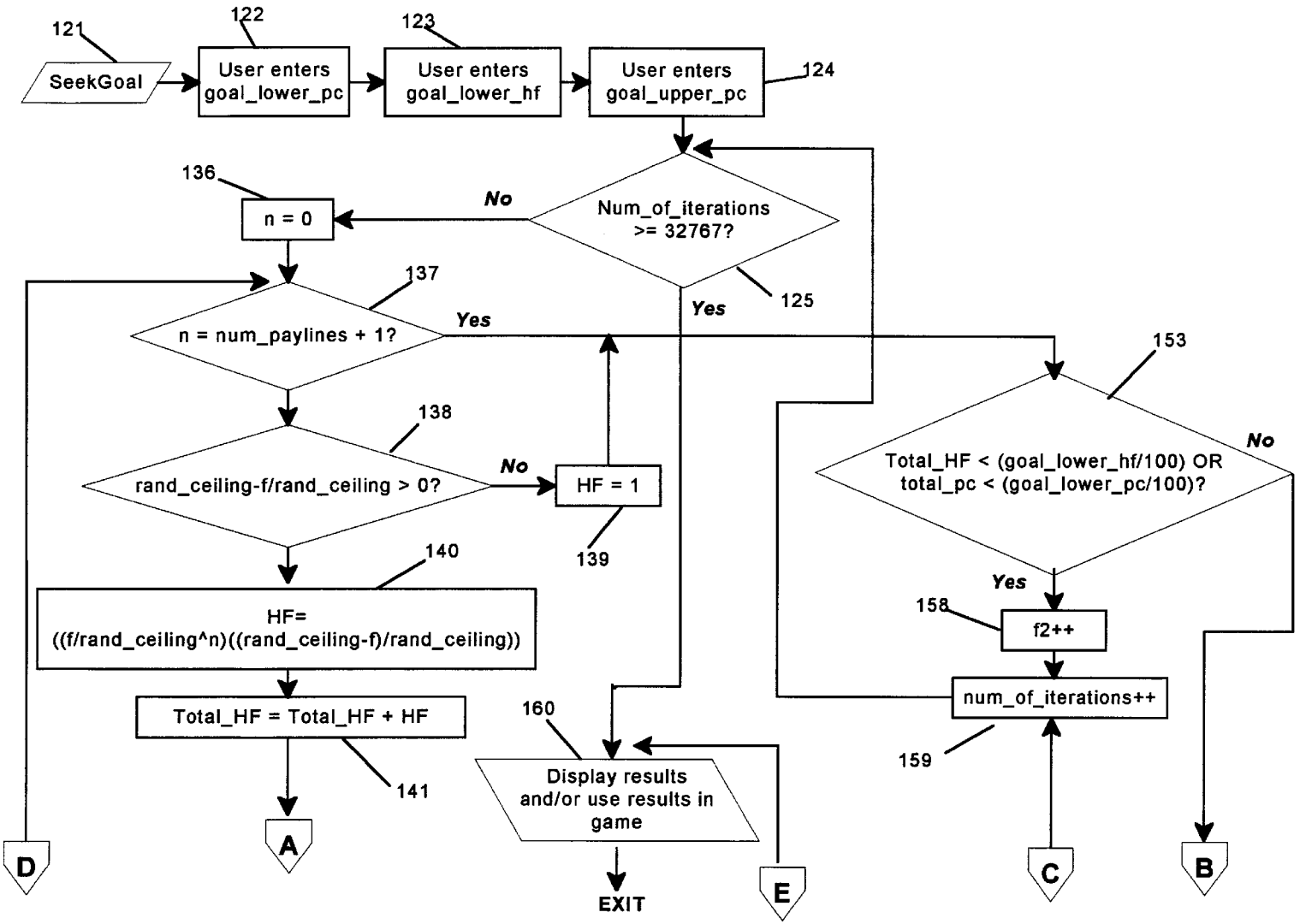

In order to randomly determine game outcome, a series of random numbers in the range of random floor to random ceiling (inclusive) is generated and passed through a digital filter. The digital filter has a passband of width f. Any random number which is greater than or equal to the filter lower passband and which is less than or equal to the filter upper passband is deemed to have passed the filter and is counted. For the sake of simplicity in explanation and example, we will set the filter lower passband to 1. The probability ($P_n$) that exactly n numbers will sequentially pass through the digital filter is $P_n$=((f/rand_ceiling)^n)*((rand_ceiling−f)/rand_ceiling). The term (f/rand_ceiling)^n represents the probability that n random numbers selected as described will be within the passband of the filter. The term ((rand_ceiling−f)/rand_ceiling) represents the probability that a random number selected as described will not be within the passband of the filter. The probability of both events occurring is the product of the two events described previously. It may be seen that by proper selection of a range of random numbers, digital filter passband f and/or length of sequence of random numbers which must sequentially pass through the filter n that any probability of the range of random numbers passing through the filter may be designed. A computer flow diagram which may be used to select parameters described for a single line game for which a pay table is illustrated below as Pay table 1 is illustrated in FIG. 7. This computer flow diagram illustrates an iterative method for arriving at desired values and selects results which are within a range of values given as input values.

PAY TABLE 1

| Coins played = 1 | Coins Played = 2 | Coins played = 3 | Coins played = 4 | Symbols | |
|---|---|---|---|---|---|
| 800 | 1600 | 2400 | 3200 | SP SP SP | Payline6 |
| 50 | 100 | 150 | 200 | 5B 5B 5B | Payline5 |
| 20 | 40 | 60 | 80 | CH CH CH | Payline4 |
| 10 | 20 | 30 | 40 | BA BA BA | Payline3 |
| 5 | 10 | 15 | 20 | AB AB AB | Payline2 |
| 2 | 4 | 6 | 8 | ACH ACH ACH | Payline1 |

The probability of the amount paid out to the player (P.C.) and the number of games which will result in a win (H.F.) may be calculated as follows for the following specific example: The digital filter will be given a passband of 1 through 9, the range of random numbers generated will be 1 through 37. The quantity of random numbers which must pass through the filter passband in a game to obtain an award as indicated by a payline on the pay table for 1 coin played is 1 for Payline1, 2 for Payline2, 3 for Payline3, 4 for Payline4, 5 for Payline5 and 6 for Payline6. The quantity of random numbers generated and presented to the filter input for each game will be 6.

Payline1

H.F.=(9/37)^1*(37−9)/37=0.18408 (1 random number within the filter passband)

Payline2

H.F.=(9/37)^2*(37−9)/37=0.04478 (2 random numbers within the filter passband)

Payline3

H.F.=(9/37)^3*(37−9)/37=0.01089 (3 random numbers within the filter passband)

Payline4

H.F.=(9/37)^4*(37−9)/37=0.00265 (4 random numbers within the filter passband)

Payline5

H.F.=(9/37)^5*(37−9)/37=0.00064 (5 random numbers within the filter passband)

Payline6

H.F.=(9/37)^6*(37−9)/37=0.00016 (6 random numbers within the filter passband)+[(9/37)^7*(37−9)/37=0.00004 (7 random numbers within the filter passband)]+[(9/37)^8*(37−9)/37=0.00001 (8 random numbers within the filter passband)]+[(9/37)^9*(37−9)/37~=0.00000 (9 random numbers within the filter passband)]=0.00021

The total H.F. is the summation of the individual H.F. and is equal to 0.24325 which predicts that approximately 1 out of every 4 games played (over a very large number of games sampled) will result in an award of some type to the player. The P.C. is calculated as the number of coins played divided by the number of coins paid to the player. The theoretical P.C. for 1 coin play is as shown below:

Payline 1

P.C.=(Paylinel H.F.)(Number Coins Played/Number Coins Paid)=(0.18408)(2)/1=0.36816

Payline2

P.C.=(Payline2 H.F.)(Number Coins Played/Number Coins Paid)=(0.04478)(5)/1=0.22390

Payline3

P.C.=(Payline3 H.F.)(Number Coins Played/Number Coins Paid)=(0.01089)(10)/1=0.10890

Payline4

P.C.=(Payline4 H.F.)(Number Coins Played/Number Coins Paid)=(0.00265)(20)/1=0.05300

Payline5

P.C.=(Payline5 H.F.)(Number Coins Played/Number Coins Paid)=(0.00064)(50)/1=0.03200

Payline6

P.C.=(Payline6 H.F.)(Number Coins Played/Number Coins Paid)=(0.00021)(800)/1=0.1680

Total P.C. is the summation of the individual P.C. for each payline and is equal to 0.95396 which predicts that approximately 95.396% of the coins played (over a very large number of games sampled) will be returned to the player. coins played (this game is generally known as a "multiplier") and the P.C. is independent of the number of coins played.

Figure 6:
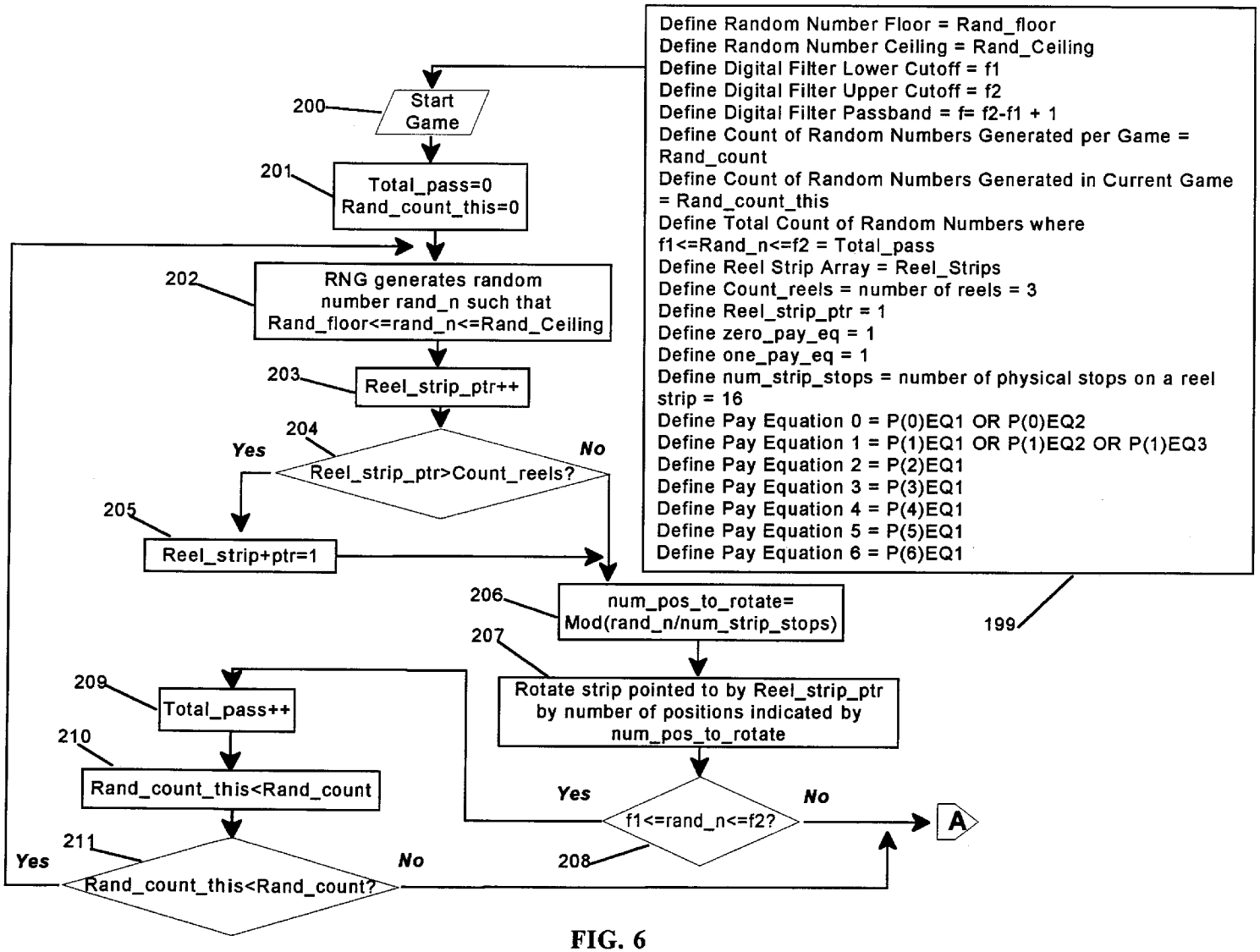
FIGS. 6 and 6A are a computer flow diagram illustrating a preferred embodiment of the invention for a single line game.
Figure 6A:
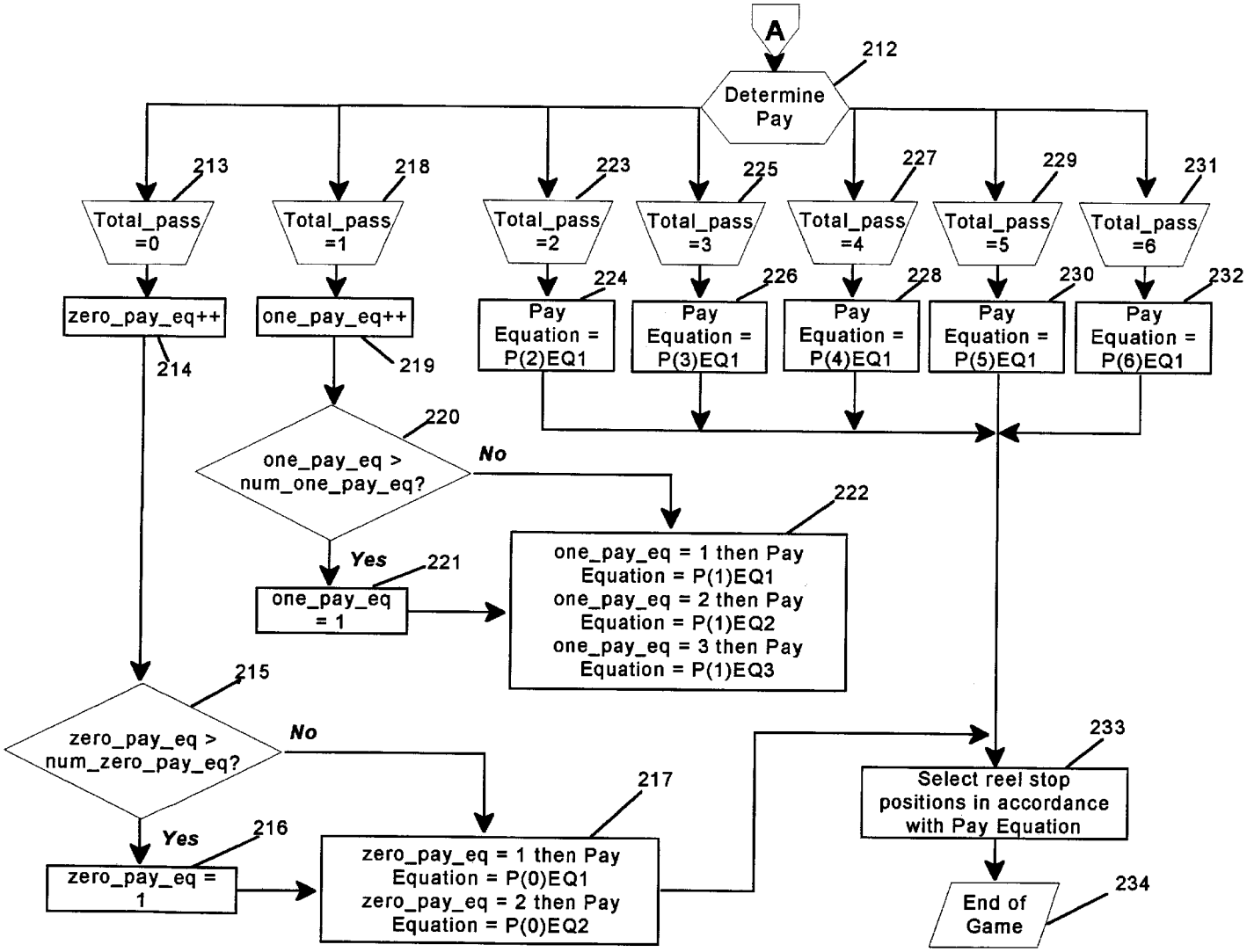

FIG. 6 is a computer flow diagram illustrating steps performed by a microprocessor to practice the present invention for a single line game. These steps may be stored in Erasable Programmable Read Only Memory (EPROM), 301 and are executed by the microprocessor 8 upon playing a game. Random Access Memory (RAM), 300 is associated with the microprocessor for purpose of allowing storage of variables required for performance of steps required to play a game. An award table (pay table) which describes to a player the amount of payoff which will be returned upon the display of certain reel symbols is shown below as Table 1. FIG. 3 illustrates a table in computer memory within which are stored physical stop positions of the reels.

The discussion which follows illustrates the present invention as applies to Pay table 1 using the reel strips illustrated in FIG. 3; many advantages and applications to other games will become apparent to those skilled in the art to which the invention pertains from the illustration.

The sequence of events illustrated in FIG. 6 begins subsequent to the slot machine receiving valid coins and being given a command to play the game; upon command to play the game, all reels are set into motion (rotate). A set of initialization parameters 199 is set in computer memory prior to start game step 200; the initialization parameters are generally placed into computer memory upon first application of electrical power to the apparatus. The initialization parameters may include random number floor, random number ceiling, digital filter passband lower cutoff, digital filter upper cutoff, count of random numbers generated for a game, reel strip array, number of reels, a pointer to a specific reel strip, a pointer to a set of zero pay equations, a pointer to a set of pay equations for which the payoff is indicated on payline one of the pay table, number of physical stops on a reel strip and payline equations. The payline equations are equations written in terms of pay table symbols which, when solved, will yield a solution in terms of reel strip symbols which may be displayed beneath a payline to indicate results of a game to a player. Registers which hold results of total count of random numbers generated which are within the digital filter passband and of the total count of random numbers generated for the game are set to a value of zero in step 201. A random number generator (RNG) program in microprocessor 8 generates a random number within a range which is greater than or equal to a previously determined random floor and which is less than or equal to a previously determined random ceiling. A pointer to the number of reels in the machine is incremented and, if greater than the count of reels in the machine, is reset to a value of 1. The number of positions to which to move a pointer to beginning of a reel strip in computer memory is determined by means of division of the random number generated in step 202 by the count of physical stops on a reel strip and using the remainder of this process as the count of positions to move the pointer (the random number is divided by the number of physical reel strip stops modulus the number of physical reel strip stops). The pointer to the beginning of a reel strip in computer memory is moved in step 206. The process described is illustrated in FIG. 3 which shows the initial positions of the reel strip symbols in computer memory. As an illustration, the first random number generated is 1, the second random number generated is 10, the third random number generated is 37. The pointer to the beginning of reel strip 1 is moved downward by 1 position, the pointer to the beginning of reel strip 2 is moved downward by 10 positions and the pointer to the beginning of reel strip 3 is moved downward by 5 positions (37 divided by 16 equals 2 remainder 5).

The image of the adjusted reel strips in computer memory is illustrated in FIG. 4. The process of rotating reel images in computer memory described above is not necessary in determining outcome of a game, but adds player enjoyment by presenting continually changing combinations beneath the payline as may be seen in further discussion. When a symbol is beneath the payline, a bottom portion of a symbol on the reel strip preceding the symbol beneath the payline is visible along with a top portion of a symbol on the reel strip succeeding the symbol beneath the payline; the aforesaid is the display seen by a player and player enjoyment is enhanced if variety exists in the display.

In FIG. 6 the random number generated in step 202 is compared to the digital filter passband in step 208; if the random number is greater than or equal to the previously determined lower limit of the filter passband and is less than or equal to the previously determined upper limit of the filter passband, the total count of random numbers generated which are within the digital filter passband is incremented by one (step 209), the total count of random numbers generated for this game is incremented by one (step 210), the total count of random numbers generated for this game is then compared to a previously determined count of random numbers generated for a game (step 211) and if the count of random numbers generated for this game is less than the previously determined count of random numbers generated for a game, the program proceeds back to step 202. If the count of random numbers generated for this game is equal to the previously determined count of random numbers generated for a game, the program proceeds to step 212 to determine a payoff. If the random number is less than the previously determined lower limit of the filter passband or is greater than the previously determined upper limit of the filter passband (step 208) a losing game results and the program proceeds to step 212 for payoff determination; in this case the total count of numbers generated within the filter passband is zero (step 213). A counter in computer memory which is the zero pay equation counter is incremented by one (step 214) and, if greater than a previously determined count of zero pay equations, is set to 1.

Figure 5:
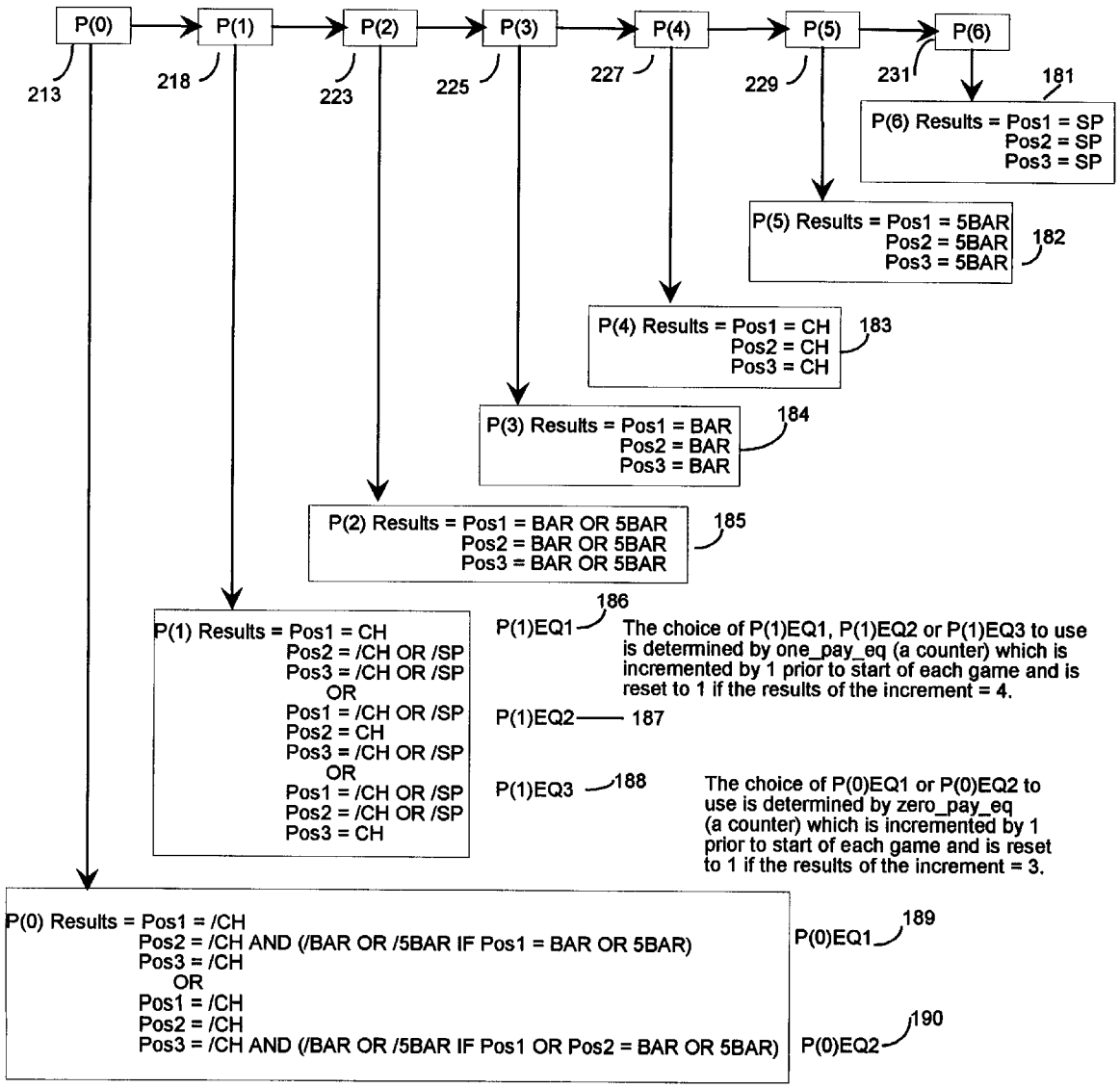
FIG. 5 is a diagram illustrating method of calculating payoff amount dependent upon the count of random numbers present at a digital filter tap after playing a game.

The zero pay equation counter is used as a pointer to select a zero pay equation which may be as illustrated in FIG. 5, P(0)EQ2, 190. The zero pay equation selected indicates that reel 1 should indicate beneath the payline any symbol with the exception of a "Cherry", reel 2 should indicate beneath the payline any symbol with the exception of a "Cherry", and reel 3 should indicate beneath the payline any symbol with the exception of a "Cherry" and with the additional constraint that if reel 1 or reel 2 has a symbol of a "Bar" or a "5Bar" beneath the payline that reel 3 should not indicate a "Bar" or "5Bar" beneath the payline.

Turning to FIG. 3, the first occurrence of the condition just described (beginning from the top of all strips) is position 2 of all three reel strips which would indicate "Blank", "Blank", Blank" beneath the payline. For illustration, refer to FIG. 4 in which the first occurrence of the condition just described (beginning from the top of all strips) is position 1 of all three reel strips which would indicate "Blank", "Special Symbol", Blank" beneath the payline. If the total count of random numbers generated which are within the digital filter passband is equal to 1 (step 218), a counter in computer memory which is the one coin pay equation counter is incremented by one (step 219) and if greater than a previously determined count of one coin pay equations is set to 1.

The one coin pay equation counter is used as a pointer to select a one coin pay equation which may be as illustrated in FIG. 5, P(1)EQ2, 187. The one coin pay equation selected indicates that reel 1 should indicate beneath the payline any symbol with the exception of a "Cherry" or a "Special Symbol", reel 2 should indicate beneath the payline a "Cherry", and reel 3 should indicate beneath the payline any symbol with the exception of a "Cherry" or a "Special Symbol".

Turning to FIG. 3, the first occurrence of the condition just described (beginning from the top of all strips) is position 2 of reel 1, position 1 of reel 2 and position 2 of reel 3 which would indicate "Blank", "Cherry", "Blank" beneath the payline. For another illustration, refer to FIG. 4 in which the first occurrence of the condition just described (beginning from the top of all strips) is position 1 of reel 1, position 3 of reel 2 and position 1 of reel 3 which would indicate "Blank", "Cherry", "Blank" beneath the payline, but which is shows a different combination of symbols to a player. If the total count of random numbers generated which are within the digital filter passband is equal to 2 (step 223), a two coin pay equation selected indicates that reel 1 should indicate beneath the payline a symbol which is a "Bar" or a "5Bar", reel 2 should indicate beneath the payline a "Bar" or a "5Bar" and reel 3 should indicate beneath the payline a "Bar" or a "5Bar".

Turning to FIG. 3, the first occurrence of the condition just described (beginning from the top of all strips) is position 3 of reel 1, position 3 of reel 2 and position 3 of reel 3 which would indicate "Bar", "Bar", "Bar" beneath the payline. For another illustration, refer to FIG. 4 in which the first occurrence of the condition just described (beginning from the top of all strips) is position 4 of reel 1, position 5 of reel 2 and position 2 of reel 3 which would indicate "Bar", "Bar", "5Bar" beneath the payline. If the total count of random numbers generated which are within the digital filter passband is equal to 3 (step 225), a three coin pay equation selected indicates that reel 1 should indicate beneath the payline a symbol which is a "Bar", reel 2 should indicate beneath the payline a "Bar" and reel 3 should indicate beneath the payline a "Bar".

Turning to FIG. 3, the first occurrence of the condition just described (beginning from the top of all strips) is position 3 of reel 1, position 3 of reel 2 and position 3 of reel 3 which would indicate "Bar", "Bar", "Bar" beneath the payline. For another illustration, refer to FIG. 4 in which the first occurrence of the condition just described (beginning from the top of all strips) is position 4 of reel 1, position 5 of reel 2 and position 8 of reel 3 which would indicate "Bar", "Bar", "Bar" beneath the payline. If the total count of random numbers generated which are within the digital filter passband is equal to 4 (step 227), a four coin pay equation selected indicates that reel 1 should indicate beneath the payline a symbol which is a "Cherry", reel 2 should indicate beneath the payline a "Cherry" and reel 3 should indicate beneath the payline a "Cherry".

Turning to FIG. 3, the first occurrence of the condition just described (beginning from the top of all strips) is position 1 of reel 1, position 1 of reel 2 and position 1 of reel 3 which would indicate "Cherry", "Cherry", "Cherry" beneath the payline. For another illustration, refer again to FIG. 4 in which the first occurrence of the condition just described (beginning from the top of all strips) is position 2 of reel 1, position 3 of reel 2 and position 6 of reel 3 which would indicate "Cherry", "Cherry", "Cherry" beneath the payline. If the total count of random numbers generated which are within the digital filter passband is equal to 5 (step 229), a five coin pay equation selected indicates that reel 1 should indicate beneath the payline a symbol which is a "5Bar", reel 2 should indicate beneath the payline a "5Bar" and reel 3 should indicate beneath the payline a "5Bar".

Turning to FIG. 3, the first occurrence of the condition just described (beginning from the top of all strips) is position 5 of reel 1, position 5 of reel 2 and position 5 of reel 3 which would indicate "5Bar", "5Bar", "5Bar" beneath the payline. As another illustration, consider FIG. 4 in which the first occurrence of the condition just described (beginning from the top of all strips) is position 6 of reel 1, position 7 of reel 2 and position 2 of reel 3 which would indicate "5Bar", "5Bar", "5Bar" beneath the payline. If the total count of random numbers generated which are within the digital filter passband is equal to 6 (step 231), a six coin pay equation selected indicates that reel 1 should indicate beneath the payline a symbol which is a "Special Symbol", reel 2 should indicate beneath the payline a "Special Symbol" and reel 3 should indicate beneath the payline a "Special Symbol".

Returning again to FIG. 3, the first occurrence of the condition just described (beginning from the top of all strips) is position 7 of reel 1, position 7 of reel 2 and position 7 of reel 3 which would indicate "Special Symbol", "Special Symbol", "Special Symbol" beneath the payline. Referring to FIG. 4, the first occurrence of the condition just described (beginning from the top of all strips) is position 8 of reel 1, position 1 of reel 2 and position 4 of reel 3 which would indicate "Special Symbol", "Special Symbol", "Special Symbol" beneath the payline. After selection of reel stop positions in accordance with the pay equations as described above, the reels are stopped in accordance with stop positions selected and the apparatus awaits play of a new game (step 234).

It should be noted that any solution of a pay equation corresponds to one and only one reel stop position, since the first occurrence of a desired symbol upon a reel strip ends a physical stop selection process for the reel strip and the physical stop selection process continues until a physical stop has been selected in aforesaid manner for all reels present in the gaming apparatus.

A computer flow diagram for purposes of determining digital filter passband lower cutoff frequency (f1), passband upper cutoff frequency (f2), range of random numbers to be generated comprising a game and count of random numbers to be generated comprising a game (game parameters) is illustrated in FIG. 7. This computer flow diagram begins at step 121 and allows for entry of desired lower bound of PC (step 122), for entry of desired lower bound of hit frequency (step 123) and for entry of desired upper bound of PC (step 124). A maximum number of iterations for solution of game parameter dependent upon the aforesaid conditions entered is allowed in step 125 and if no solution can be found within the maximum number of iterations, the program is caused to terminate at step 160. If the maximum number of iterations permitted is not exceeded, a trial set of game parameters is selected by means of proceeding to step 136 which initializes a loop counter to zero and compares it to a count which is equal to the number of paylines in a specific game pay table +1 (step 137). If the loop counter is less than the number of paylines in the game pay table +1 the program is caused to proceed to step 138 where an out of bounds condition is tested, where the out of bounds condition is the random ceiling (greatest value random number to be generated in a game sequence) minus the width of the digital filter passband (f2−f1) divided by the random ceiling. If step 138 yields a value which is less than zero, hit frequency is set to 1 which is a guaranteed out of bounds condition and the program is caused to proceed to step 157. If step 138 yields a value which is less than zero, the hit frequency is calculated in step 140 as the quantity formed by dividing the digital filter passband width by the random ceiling, quantity raised to the power of the payline counter "n" times the quantity formed by the random ceiling minus digital filter passband width divided by the random ceiling. Total calculated hit frequency is updated in step 141 by adding the hit frequency calculated in step 140 to the hit frequency previously calculated. A decision to calculate hit frequency for each payline based upon value of loop counter "n" is performed at step 142 and depending upon the value of loop counter "n" (step 126, 129, 132, 143, 147, 150) a value for PC at every individual payline is calculated by means of multiplication of the number of coins awarded by that payline by the hit frequency calculated for the corresponding payline (step 127, 130, 133, 144, 148, 151). The individual payline PC and the hit frequency are updated at step 128, 131, 134, 145, 149, 152 and total PC is updated in step 146. Loop counter "n" is incremented and a test is made at step 137 to verify that a calculation of total PC and total hit frequency for the entire pay table has occurred. The values calculated for total PC and total hit frequency previously calculated are compared to values previously entered in step 123 and step 122. If the total hit frequency is less than the desired lower bound of lower hit frequency or if the total PC is less than the desired lower bound of lower PC, the upper passband f2 of the digital filter is incremented by one (step 158) the number of iterations is incremented one time (step 159) and a new calculation of total PC and total hit frequency is done by returning to step 125. If the conditions of step 157 are not met, i.e., if total hit frequency is greater than or equal to the desired lower bound of lower hit frequency, total PC is less than or equal to the desired upper bound of PC and total PC is greater than or equal to the desired lower bound of PC, then the program is caused to terminate at step 160 and the game parameters are available for use in playing a game. If the conditions required at step 153 are not met, the program is caused to proceed to step 154 in which the random ceiling is incremented by one. The program then proceeds to step 155 in which the digital filter passband lower limit is set equal to 1 after which the program proceeds to step 156. The digital filter upper limit is set equal to the count of paylines in the game pay table, the count of iterations is incremented in step 159 and if the count of iterations is less than the maximum count value allowed in step 125, a new value of total PC and hit frequency is calculated by proceeding to step 136. The game parameter determinations illustrated above are for a single line game. Game parameter determinations for multi-payline games and for payoff weighting are not illustrated in detail as such game parameter determinations will become clear to those skilled in the art taken together with the discussion above and further disclosure of advantages of the present invention below. For example, it will be apparent to one skilled in the art that special and multiline games can be realized by employment of a separate digital filter for each line and deriving equations as previously shown for each additional payline combination.

Filter taps may be defined for purposes of this description as computer memory locations in which cumulative results of the actions of the digital filter upon a succession of a series of random numbers are stored; such filter taps are illustrated in FIG. 5, at 213, 218, 223, 225, 227, 229, and 231. Weighting of hit frequency (HF) and hence control of the volatility of a game (rate of change of PC with respect to number of games played or size of variance of PC) can be achieved by means of multiplication of the outcome of the results of previously determined filter taps and feeding them forward into a selected filter tap or taps.

Results are fed forward since this action does not imply that results obtained previously are being altered by results obtained subsequently to them; a situation which may not be allowed by gaming jurisdictions. Results obtained at a filter tap may be altered by results fed back (returned to the filter tap from a succeeding filter tap) if feedback is permitted.

All numbers which are within the filter bandpass which are accumulated at filter taps are not required to be mapped one on one to a payline, but some additional filter taps can be created to use as multipliers in the manner just described to provide a desired weighting or shaping to a desired win probability.

Figure 13:
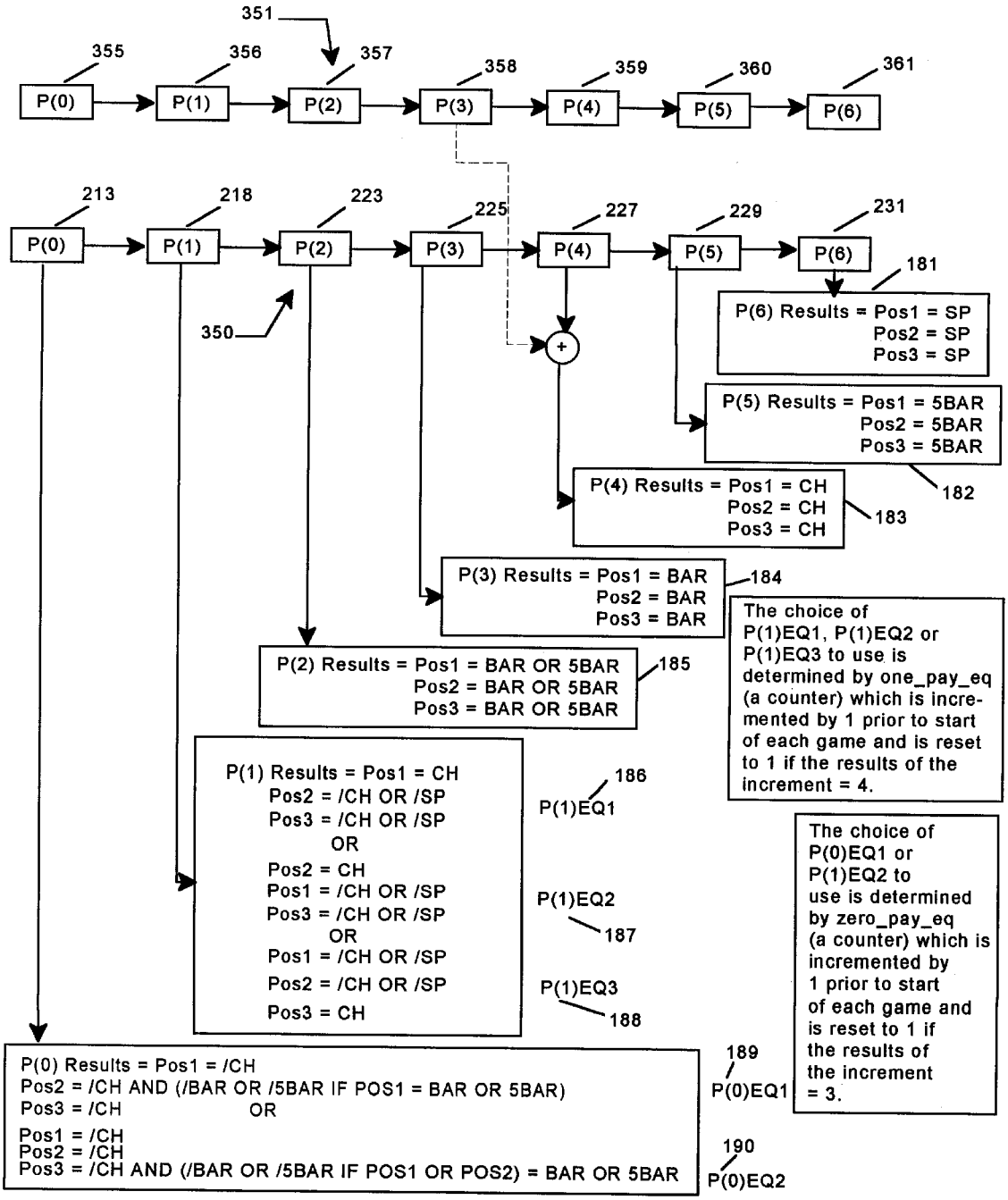
FIG. 13 is a diagram illustrating method of calculating weighted payoff amount dependent upon the count of random numbers present at a digital filter tap after playing a game.

FIG. 13 illustrates an example wherein two digital filters 350 and 351 are employed, both having the same characteristics, though normally digital filter 351 would have different characteristics from digital filter 350. Both digital filters have a passband of 1 through 7 and the range of random numbers generated is 1 through 31. The count of random numbers generated and presented to both digital filter inputs for a game is 6. The count of random numbers which must pass through the passband of digital filter 350 for a game to obtain an award as indicated by a payline on Pay table 1 for 1 coin played is 1 for Payline1, 2 for Payline2, 3 for Payline3, 4 for Payline4, 5 for Payline5 and 6 for Payline6.

As an illustration (FIG. 13), consider taking results of P(3), 358 filter tap and feeding these results forward into P(4), 227 filter tap with a result that P(4) is reset to the quantity P(4)+P(3). Calculations predicting game outcome follow:

Payline1

H.F.=(7/31)^1*(31−7)/31=0.17482 (1 random number within the filter passband)

Payline2

H.F.=(7/31)^2*(31−7)/31=0.03948 (2 random numbers within the filter passband)

Payline3

H.F.=(7/31)^3*(31−7)/31=0.00891 (3 random numbers within the filter passband)

Payline4

H.F.=(7/31)^4*(31−7)/31=0.01092 (4 random numbers within the filter passband)

Payline5

H.F.=(7/31)^5*(31−7)/31=0.00045 (5 random numbers within the filter passband)

Payline6

H.F.=(7/31)^6*(31−7)/31=0.00010 (6 random numbers within the filter passband)

The total H.F. is the summation of the individual H.F. and is equal to 0.23468 which predicts that approximately 1 out of every 4 games played (over a very large number of games sampled) will result in an award of some type to the player. The P.C. is calculated as the number of coins paid to the player divided by the number of coins played by the player. The theoretical P.C. for 1 coin play is as shown below:

Payline1

P.C.=(Payline1 H.F.)(Number Coins Paid/Number Coins Played)=(0.17482)(2)/1=0.34964

Payline2

P.C.=(Payline2 H.F.)(Number Coins Paid/Number Coins Playedd)=(0.03948)(5)/1=0.19740

Payline3

P.C.=(Payline3 H.F.)(Number Coins Paid/Number Coins Played)=(0.00891)(10)/1=0.0891

Payline4

P.C.=(Payline4 H.F.)(Number Coins Paid/Number Coins Played)=(0.01092)(20)/1=0.21840

Payline5

P.C.=(Payline5 H.F.)(Number Coins Paid/Number Coins Played)=(0.00045)(50)/1=0.02250

Payline6

P.C.=(Payline6 H.F.)(Number Coins Paid/Number Coins Played)=(0.00010)(800)/1=0.08000

The total P.C. is the summation of the individual P.C. and is equal to 0.95704 which predicts that approximately 95.704% of the coins played (over a very large number of games sampled) will be returned to the player. It should be noted that a large percentage of the coins returned to the player are now in the form of 20 coin pays (21.84% vs. 5.3% previous to weighting). This is only a simple example and it should be apparent that filter tap feed forward (and feed back if permitted) can be performed to modify the pay probabilities in various fashions. This is all in accordance with well known digital filter theory.

The present invention has an advantage over all previously known gaming apparatus in that it allows prediction of theoretical game outcome over a large number of games in a simple fashion, while outcome of any single game is not known until the entire count of random numbers required for a game have been generated and presented to the digital filter for evaluation. Since each random number generated has an equal chance of passing through the filter passband, it is possible for one or all random numbers minus one to pass the filter before the final random number comprising a previously defined count of random numbers constituting a game is generated.

FIG. 1 illustrates an embodiment of the present invention in which a display 15 (losing display) is used to enhance player enjoyment. Display 15 initially shows a numeral "0" and a counter in RAM is initialized to zero (losing game counter). As a player inserts coins into the gaming apparatus, the microprocessor 8 calculates a predetermined percentage of each coin inserted and adds it to a location in RAM. As game play progresses, the losing game counter is incremented upon conclusion of each game for which the payoff is zero; a digital display of the losing game counter is shown to a player upon display 15. The losing game counter increments each time a game is played for which the outcome is not a winner and the losing game counter resets to zero upon the outcome of a winning game or upon payoff of a "losing streak". A "losing streak" is defined as a predefined number of successive games played for which there was no winning outcome. Losing display 15 shows the count of successive games played for which there was no winning outcome and a legend upon the pay table informs a player that upon a predetermined count of successive losing games occurring, a payoff will be made. The payoff can be made to be quite large if the count of successive losing games is made in a range of 5–8. The payoff which occurs upon a successive series of losing games is made a part of the payout percentage of the gaming apparatus and is preferably determined in accordance with well known methods.

Figure 9:
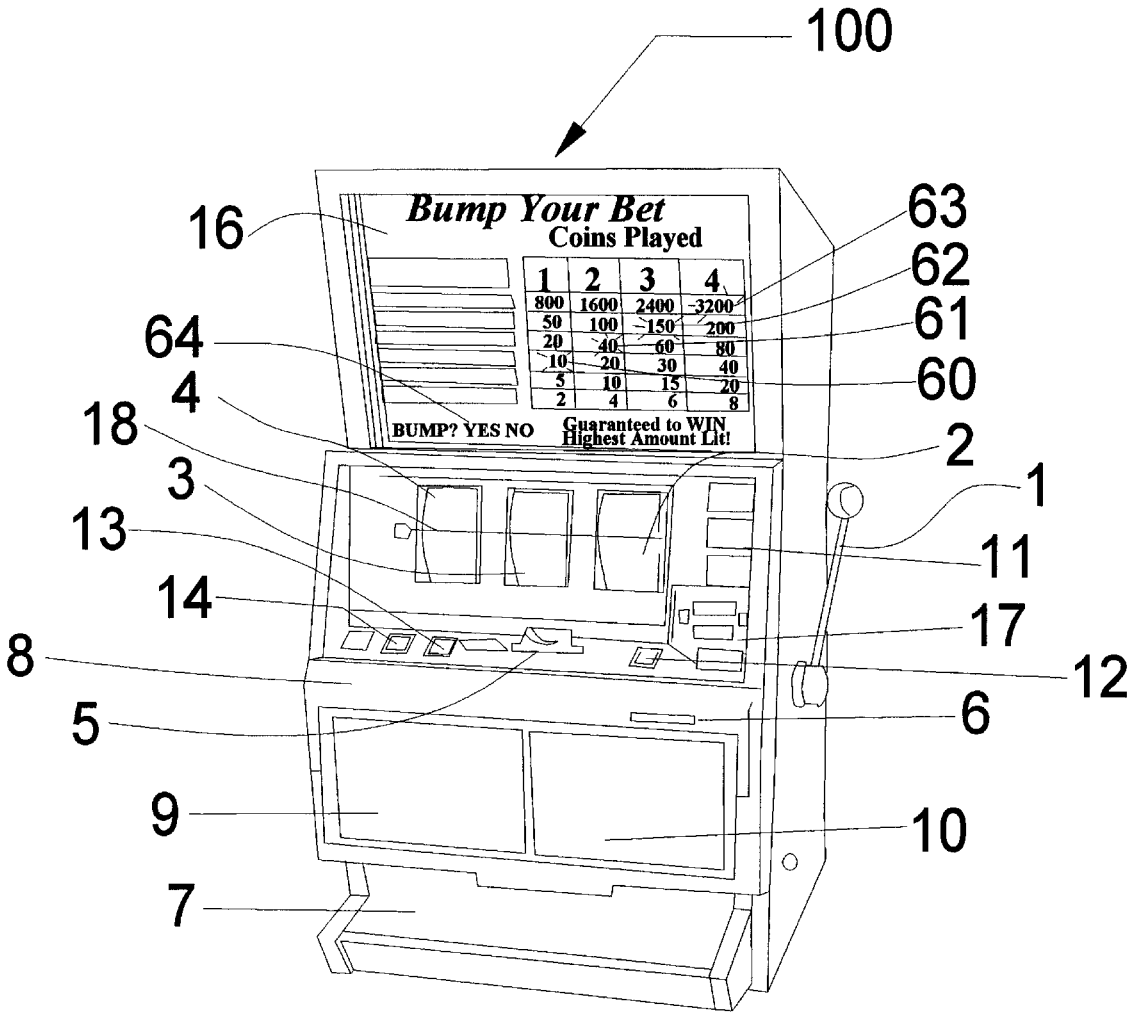
FIG. 9 is an illustration of a second type of game which is allowed by the present invention.

FIG. 9 illustrates an alternative embodiment of the present invention. Generally known gaming apparatus described above is used for purpose of constructing a game which is entertaining to a player and which is more easily realized than with art previously known. A computer flow chart illustrating the steps a microprocessor would take to play the game illustrated in FIG. 9 is given in FIG. 10. For purpose of illustration, Pay table 1 is employed as pay table 16 in the gaming apparatus 100 of FIG. 9. The present invention is employed to determine payoff of a game.

Figure 10:
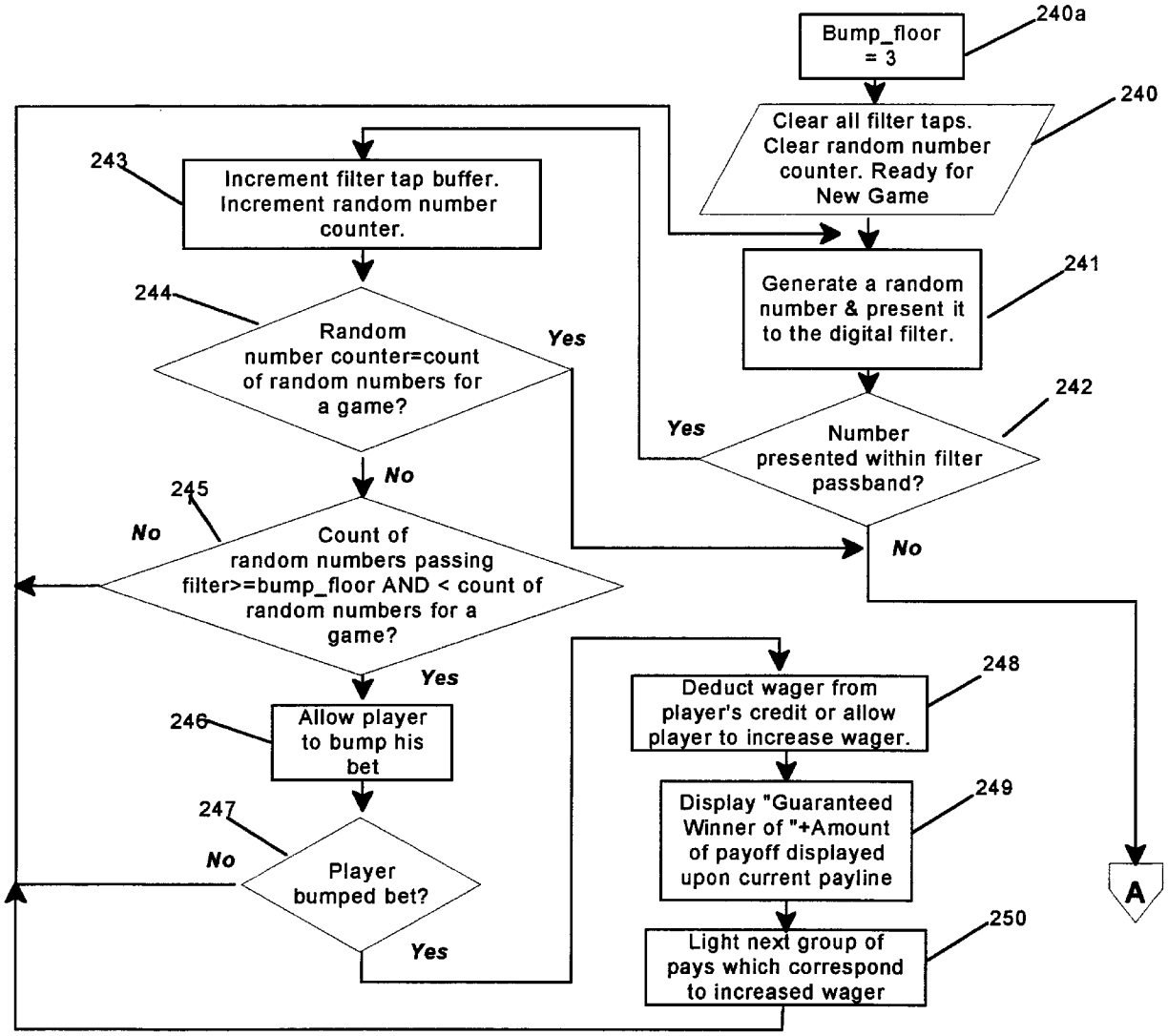
FIGS. 10 and 10A are a computer flow diagram illustrating a preferred embodiment of the game illustrated in FIG. 9.
Figure 10A:
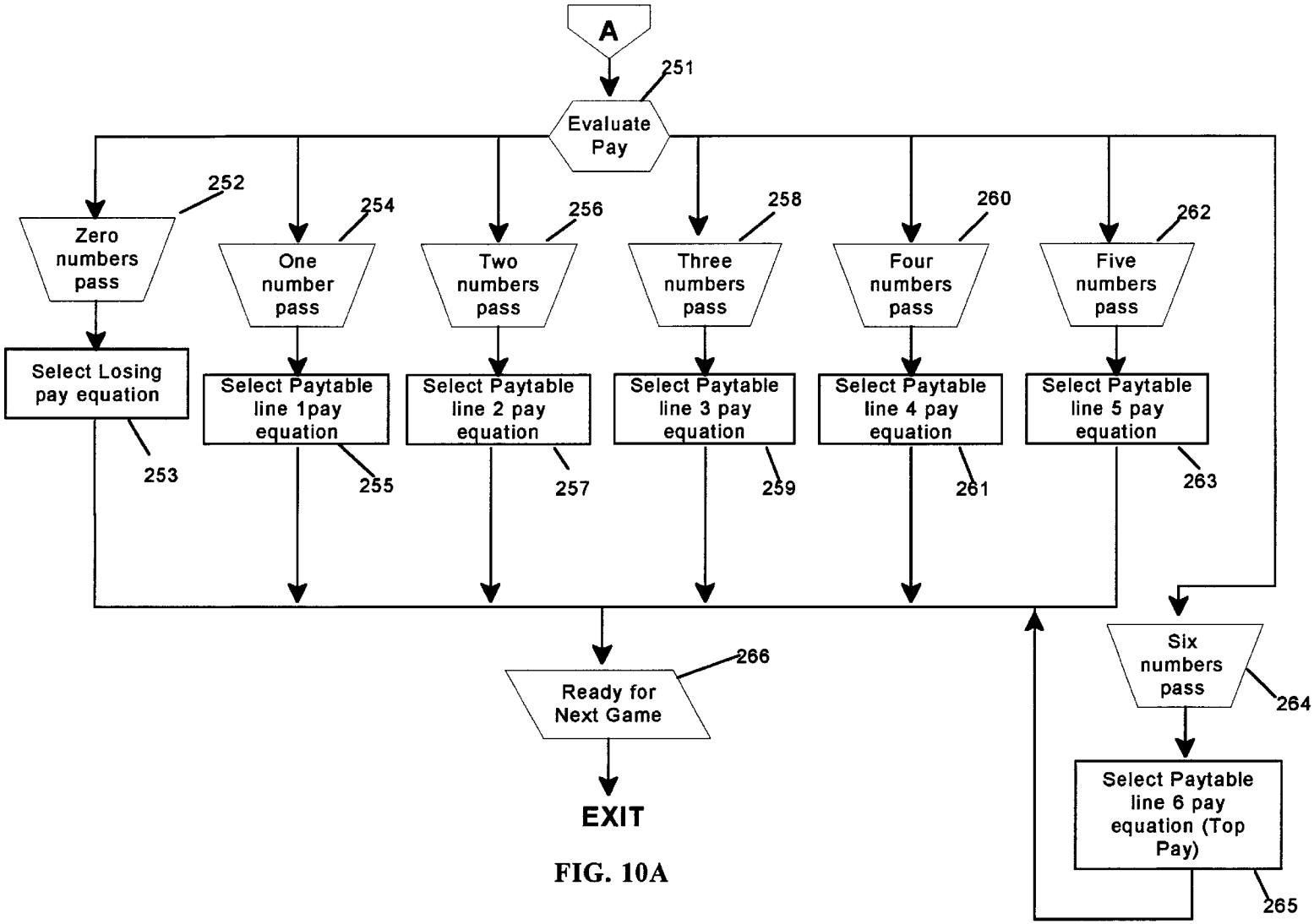

A game begins as previously described and reels 2, 3, 4 begin to rotate. A series of random numbers within a previously determined range is presented to a digital filter with a predetermined passband. If the count of random numbers within the passband of the digital filter is greater than three (a ten coin payoff) and the count of random numbers generated during the current game is less than a predetermined maximum count of random numbers to be generated for a game, the player is allowed to increase his bet (FIG. 10, step 245). If a multiplier game is chosen, it may be seen that there is no difference in the percentage payback to a player (P.C.) whether the game begins with a one coin or with a 4 coin wager. However, a player is given the chance to increase his bet ("bump" his bet) and perhaps gain a larger award if a random number later generated is within the digital filter passband. The opportunity to increase a bet is indicated to a player by means of a display 64 in pay table 16. If a player activates switch 13 when display 64 indicates "Bump?", a selection indicating "Yes" will be illuminated. A player can thus be allowed to "bump" his bet (or continue play without an increase in wager with a corresponding lower pay) each time a random number passes the filter and the count of random numbers to generated within a game cycle is less than the maximum number. This "bump" feature increases player enjoyment by allowing a player to participate in an increased payoff as a winning game proceeds. It is also apparent that with a chance of increased award comes increased risk of loss. For example, a player is given the chance to "bump" his bet after the first three random numbers generated fall within the digital filter passband and he is shown that he is "The Guaranteed Winner of the Highest Amount Lit!" which is 10 coins as shown at reference 60 in FIG. 9. A player may either "bump" his bet or not as he chooses. If he does not and the next three random numbers generated pass the digital filter passband, he is awarded the 1 coin played maximum pay of 800 coins as illustrated in column marked "Coins Played=1" of Pay table 1. In this same example if a player "bumps" his bet, the player will be given the chance to "bump" his bet on the passage through the filter of each succeeding random number generated. As a player "bumps" his bet (assuming that each succeeding random number generated is within the digital filter passband limits), each succeeding wager level on the pay table is illuminated. If a player successfully "bumps" his bet the maximum number of times allowed in this example, a payoff of 3200 coins as illustrated in column marked "Coins Played=4" of Pay table 1 results and pay levels 60, 61, 62 and 63 illustrated in FIG. 9 are illuminated.

An example of a loss can be illustrated, by assuming that no further succeeding random numbers are generated which are in the passband of the digital filter and that a player has "bumped" his bet one time. A player would win 10 coins, but would have effectively played two which is an advantage for the operator of the machine.

Yet another game which can be played using the present invention is generally known in the industry as a "skill" game or a "semiskill" game. Two examples of games in use which have been deemed to be in this category by regulatory agencies are video BlackJack and video Poker. The amount which the player can win is somewhat dependent upon the skill with which he plays the game. Spinning reel slot machines are preferred by many players and as such constitute a large percentage of the gaming machines presently in use by many major casinos. Many casinos desire to have spinning reel machines but are prevented from doing so since only games of "skill" are allowed by the regulatory agency which has jurisdiction.

Figure 11:
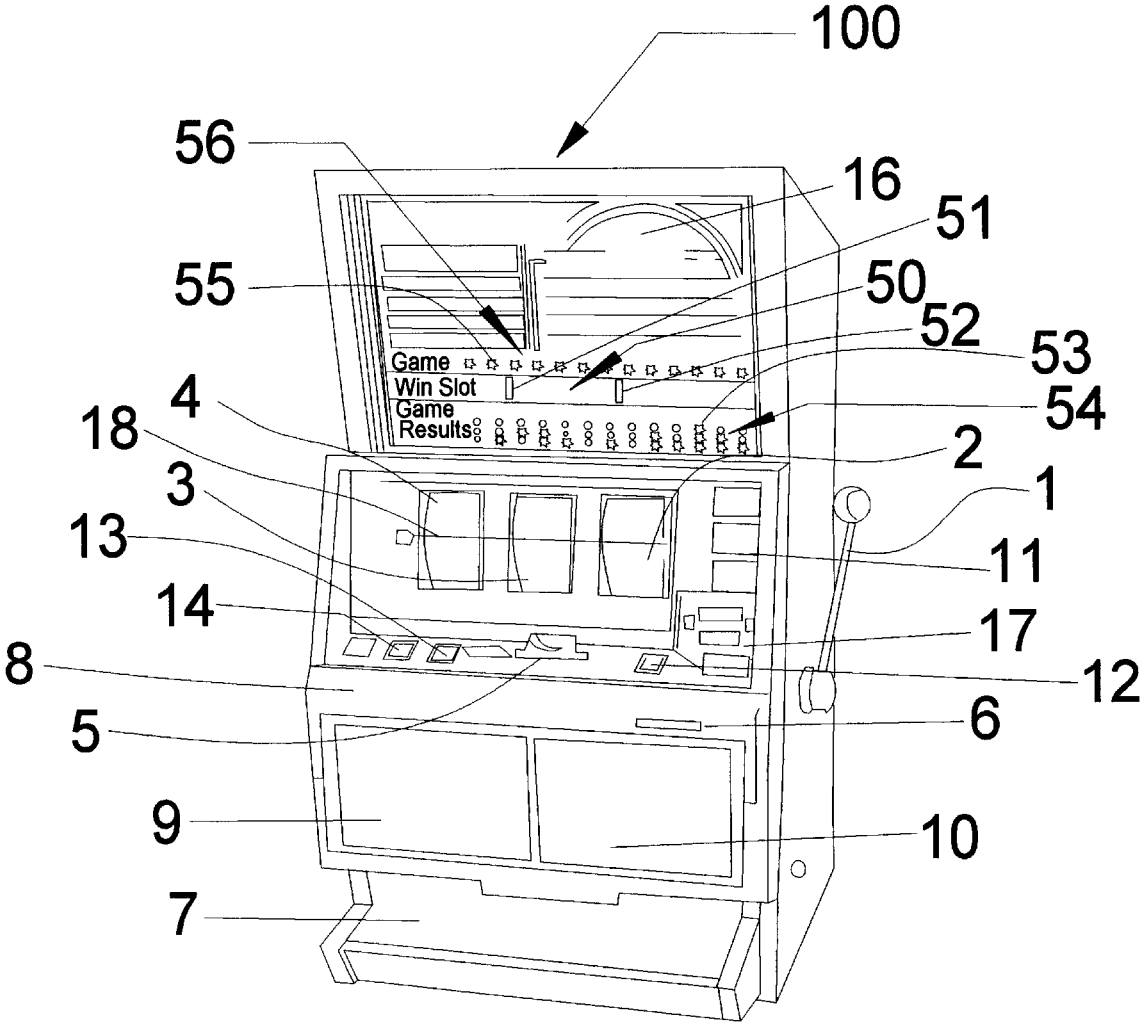
FIG. 11 is an illustration of a third type of game which is allowed by the present invention.

A preferred embodiment of a "skill" game incorporating the present invention is illustrated in FIG. 11. An array, 54 which may be comprised of light emitting diodes (LEDs), 53 is employed as a visual indicator to a player of a relative range of values of random numbers generated for determination of outcome of the previous game. A player may then judge a value about which a majority of random numbers appears to be grouping and may shift the passband of the digital filter (width of the passband remains constant) within constraints determined by a random ceiling and a random floor of random numbers to be generated as described above.

Figure 12:
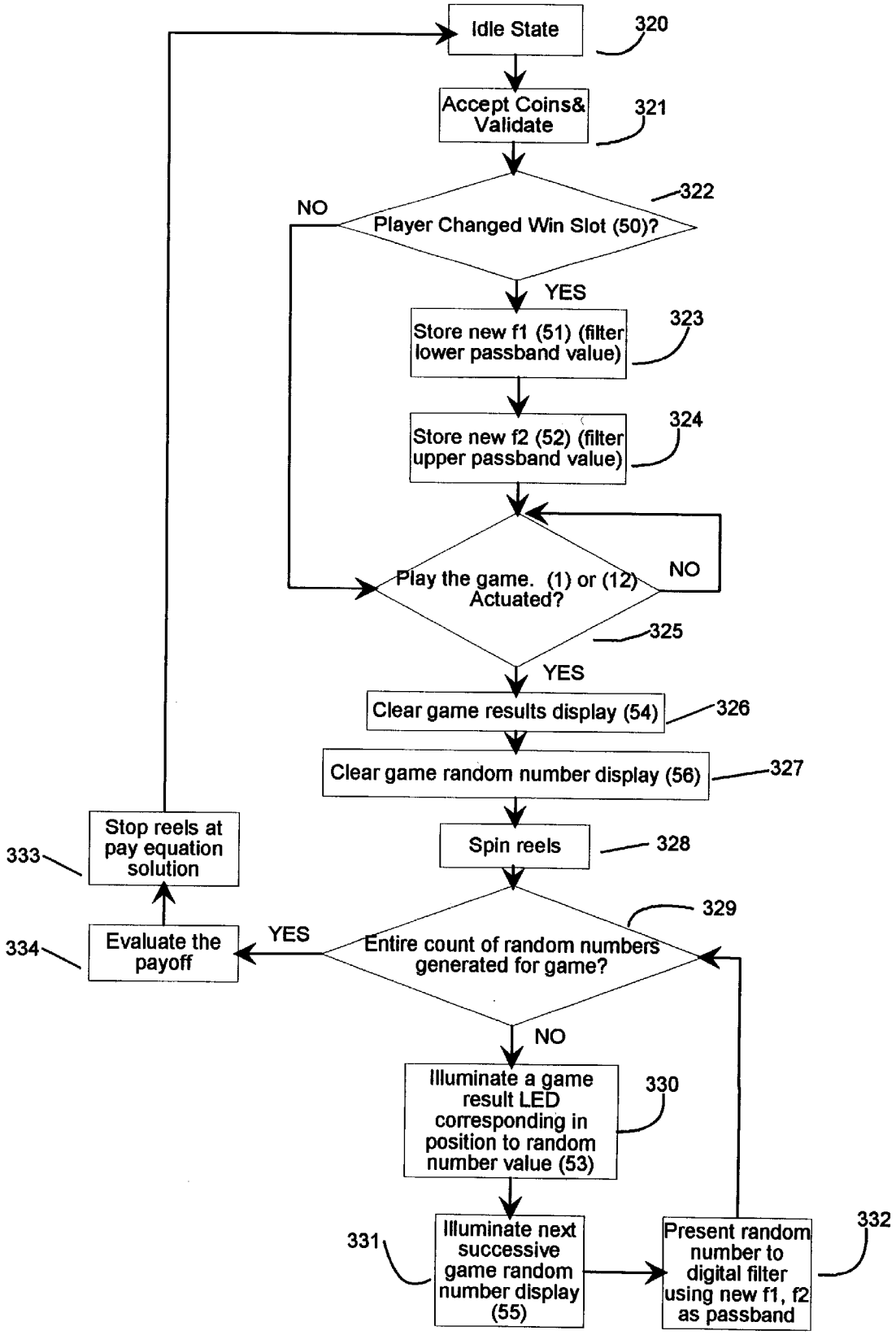
FIG. 12 is a computer flow diagram illustrating a preferred embodiment of the game illustrated in FIG. 11.

Visual indication is provided to a player to determine placement of the digital filter passband, 50 within a range of random numbers to be generated by means of light bars 51, 52 which may be comprised of LEDs. A player indicates to a microprocessor 8 within the gaming apparatus the desired direction of shift of digital filter passband by means of pressing switch 14 (move left) and switch 13 (move right). In response, the microprocessor successively energizes LEDs in a pattern representing the digital filter passband 50 and continues to shift the representation of the digital filter passband in a direction as indicated by which of the aforesaid switches (14, 15) is pressed, only while either switch is pressed. The microprocessor alters the digital filter passband lower limit (FIG. 6, f1) and digital filter passband upper limit (FIG. 6, f2) and executes the steps in the computer flowchart of FIG. 6 when commanded to play a game by means of a player actuating handle 1 or pressing switch 12. Visual indication that a random number has been generated is given to a player by means of game display 55 which may be comprised of LEDs which are successively energized as each random number is generated. If a winning game results, payoff evaluation continues as indicated by the computer flow diagram of FIG. 6; if a losing game results, remaining count of random numbers comprising a game is generated and is employed to provide information to the microprocessor to indicate results of previous game upon display 54. A computer flowchart of the game illustrated in FIG. 11 is illustrated in FIG. 12.

Figure 8:
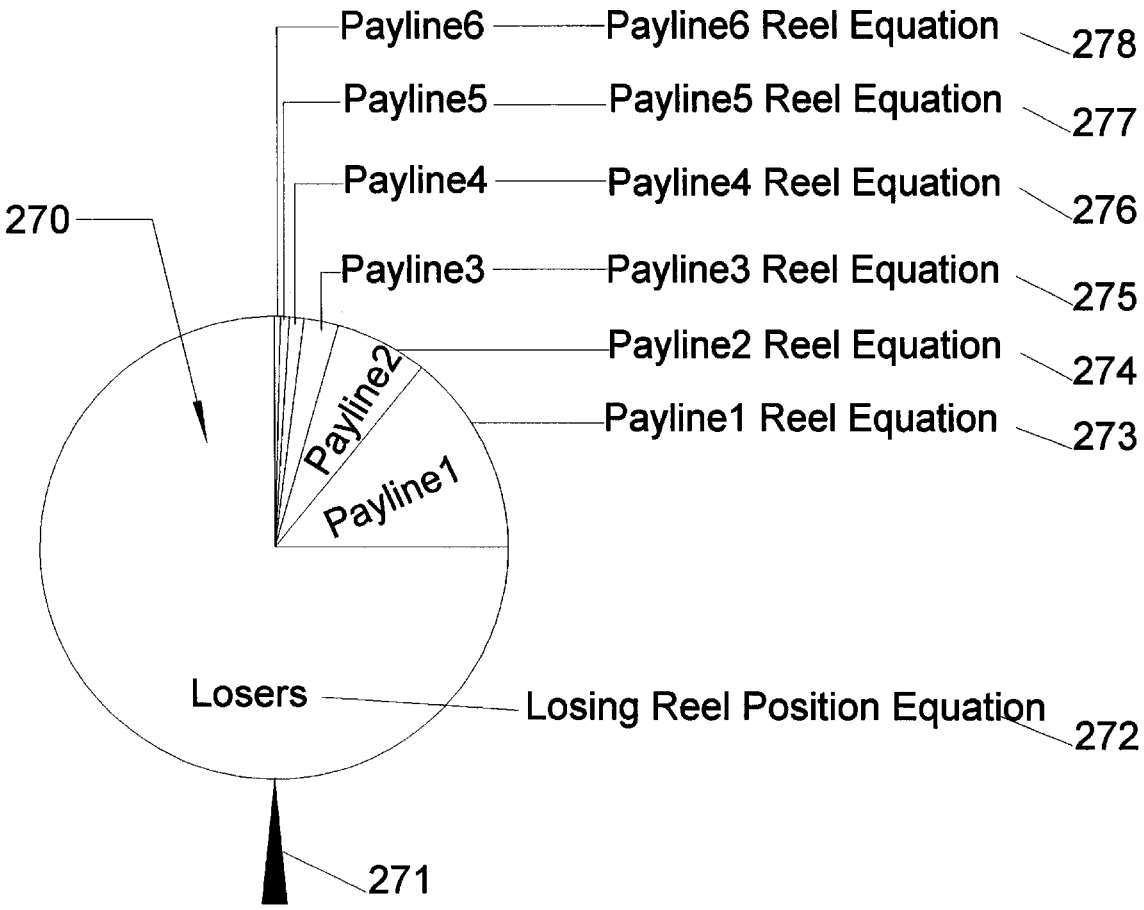
FIG. 8 is a diagrammatic representation of the pay method and apparatus of the present invention which illustrates that the total number of pay equations is equal to the number of distinct pays allowed by the machine illustrated in Table 1 plus one.

A further explanation of pay determination for the present invention is depicted in FIG. 8. The paylines displayed to the player which indicate an award to be paid upon the results of a given game outcome may be considered to be mapped onto a "pay wheel" 270 in a manner in which an area assigned to each payline is in proportion to its probability of being chosen as the outcome of a game. The "pay wheel" can be in computer memory, but can also be a mechanical device. The pay wheel is spun and the segment aligned with a fiducial mark 271 is chosen to represent game outcome. The outcome displayed for the particular game in FIG. 8 is a losing game. Game outcome is used to select a reel position equation as described earlier to indicate the game outcome to a player. The number of segments 272, 273, 274, 275, 276, 277, 278 into which the pay wheel is divided is at a minimum one plus the number of paylines on the game award table. In the majority of modem reel slot games, this will always be less than the number of physical stop positions of the physical reels. The present invention does not require an increase or decrease in the memory requirements for symbol mapping in order to provide a change in the odds of winning since it does not use a symbol mapping table.

FIG. 3 illustrates a second preferred method of selecting a physical reel strip stop for purpose of display of results of a game. As each random number is presented to the digital filter, a number-of-reel-strips counter is used as a pointer to a reel strip to select a reel strip in computer memory for which a pointer 80-82 is incremented from the present position of the pointer by a number of physical reel strip positions, where the number of positions incremented is equal to the remainder of division of the random number by the number of physical reel strip positions upon the corresponding reel strip (i.e., modulo the number of positions). The last three random numbers in the count of random numbers to produce a game are 1, 10 and 37. Pointer 80 to reel strip 1 represents a new beginning index for reel strip 1, pointer to reel strip 2 (81) represents a new beginning index for reel strip 2, pointer to reel strip 3 (83) represents a new beginning index for reel strip 3. When the increment of the number-of-reel-strips counter equals a value of number of reel strips plus one, this value equals 4, the number-of-reel-strips counter is reset to a value of 1. Solving P(0)EQ1 for a value of no random number of the count generated for a game within the digital filter would indicate that reel position 1 should not be a Cherry (/CH) which indicates that reel 1 should be stopped at the stop position indicated by pointer 80 (ReelPos2). The second term of P(0)EQ1 indicates that reel position 2 (Pos2) should not be a Cherry AND not be a Bar or 5Bar (/BAR OR /5BAR) if Reel 1 was stopped on a Bar or 5Bar. Reel 2 pointer position 81 indicates a "Blank" which satisfies the pay equation and reel 2 should be stopped at the physical stop position pointed to by pointer 81 (Reel2Pos10). The stop position of Reel 3 should be any symbol which is not equal to a "Cherry" (/CH) and since reel strip 3 pointer 83 satisfies the condition, reel 3 is stopped at the physical stop position indicated by pointer 82 (Reel3Pos5). The reel display shown to a player as the game results is "Blank", "Blank", "5Bar" which is not a winning combination as shown in Pay table 1.

If the pointer to reel strip memory does not indicate a proper solution to the pay equation, it is incremented modulus number of physical reel strip positions until a solution to the pay equation is indicated. Upon generation of the next set of random numbers for a new game, pointer movement begins from present position in memory. Note that the manner in which the pay equations are solved takes into account the natural order of stopping of the reels. Note also that all combinations of reel positions are permitted (in this case 4096) without any table other than a reel strip table existing in memory.

Figure 14:
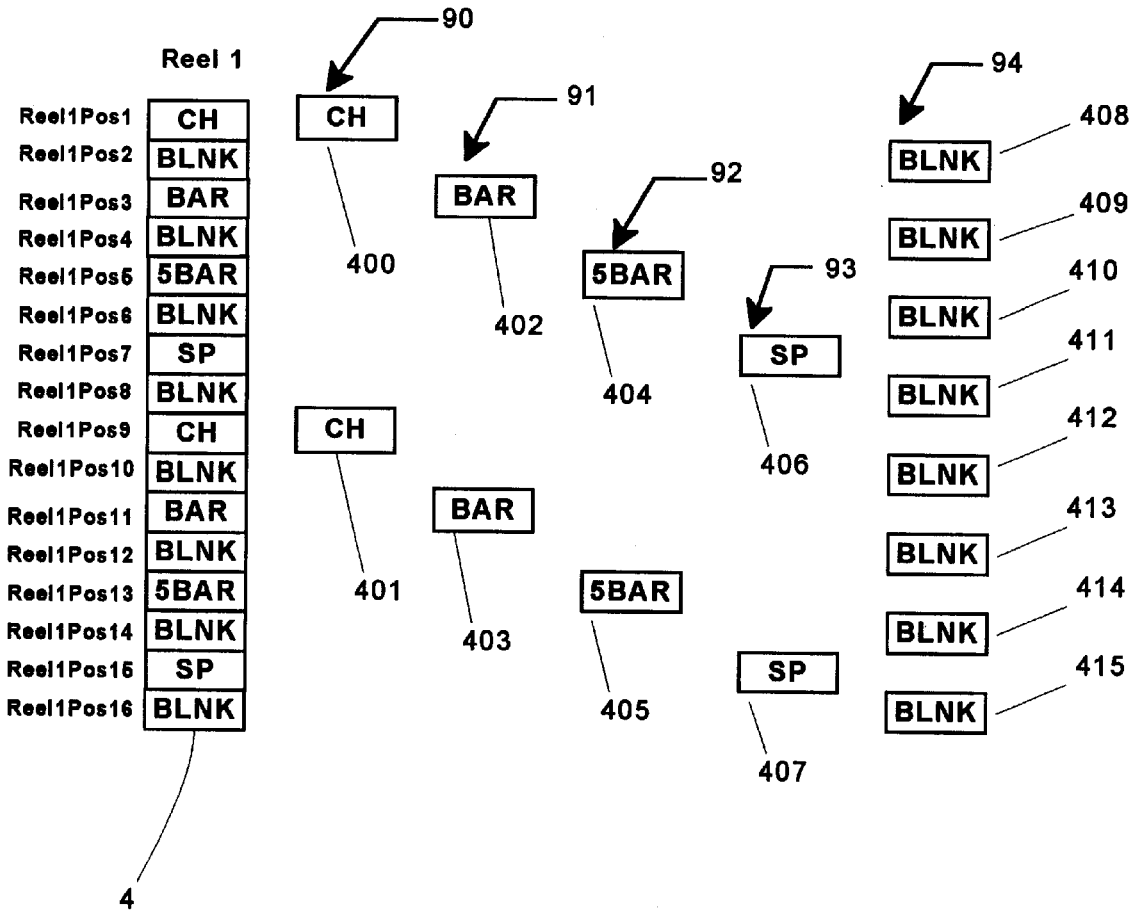
FIG. 14 is an illustration of a reel strip showing separate sets of symbols grouped by similarity.

A reel strip showing separate sets of symbols grouped as to similarity is illustrated in FIG. 14. The reel strip 4 illustrated in FIG. 14, is replicated for two other reel strips 2–3 as illustrated in FIG. 3. A method of determining a symbol upon each reel strip which will be displayed beneath the payline as results of a game outcome and not requiring a table in computer memory will be described below.

In FIG. 14, all symbols which show a "Cherry" are grouped as 91 and are symbols 400, 401; all symbols which show a "bar" are grouped as 91 and are symbols 402,403; all symbols which show a "5Bar" are grouped as 92 and are symbols 404, 405; all symbols which show a "SP" are grouped as 93 and are symbols 406, 407; all symbols which show "Blank" are grouped as 94 and are symbols 408–415. A symbol position number (SymPos) upon a reel strip may be mathematically calculated as numerical position of first occurrence of the symbol (FirstPos) plus the modulus (remainder of result) of an offset divided by the count of the symbol (nSym) times gap distance (g) to intercept the next symbol of this type beginning from position I of the reel strip. Suppose the offset is a summation of the values of the count of random numbers generated to complete a game (ΣRN); the mathematical calculation to randomly determine a symbol position may be represented as: SymPos=FirstPos+(MOD(ΣRN/nSym))(g) where MOD is the remainder resulting from division of ΣRN by nSym. To illustrate, determine position of a "Bar" symbol: consider ΣRN=16, FirstPos=3 (Bar illustrated by 402 in FIG. 14), g=8 which is number of physical stop positions which must be moved to encounter another like symbol, nSym=2 which is total count of "Bar" symbols in FIG. 14; substituting into the equation described above yields: SymPos=3+(MOD(16/2))(8)=3+(0)(8)=3. Suppose ΣRN=17 and all conditions are as described before, then the symbol position selected is "SymPos=3+(MOD(17/2))(8)=3+(1)(8)=11 which is reel position 11 occupied by the "Bar" symbol 403 illustrated in FIG. 14. A losing game equation for Pay table 1 may be written as P(0)=/CH+/CH+(/CH AND /Bar AND /5Bar) OR /CH+(/CH AND /Bar AND /5Bar)+/CH OR (/CH AND /Bar AND /5Bar)+/CH+/CH. Each element of the equation represents in order Reel 1 stop position, Reel 2 stop position and Reel 3 stop position.

The set which describes combinations to be displayed beneath the payline to indicate a losing game is composed of three separate equations:

P(0)=/CH+/CH+(/CH AND /Bar AND /5Bar), P(0)1=/CH+(/CH AND /Bar AND /5Bar)+/CH, P(0)2=(/CH AND /Bar AND /5Bar)+/CH+/CH.

Solution of either P(0)0, P(0)1 or P(0)2 will yield a valid losing set of symbols to display beneath the payline as result of a losing game. An illustration of a method to select an equation from a multiple set of valid solution equations as described above is described: number each of the solution equations as EP(0), EQ(1) . . . EQ(n). The count of the number of equations in the set is n+1. Choose the particular equation EQ(n) of the set of equations to solve by solving EQ(n)=MOD(ΣRN/n+1). The remainder of division of ΣRN by n+1 will always yield a result 0<=EQ(n)<=n.

As a specific example, let ΣRN=17 and n=3, then EQ(n)=17/4=4 remainder 1 and EQ(n)=1 which indicates that the set of symbols to be shown beneath the payline upon a losing game as selected from the set of equations P(0) above is P(0)1=/CH+(/CH AND /Bar AND /5Bar)+/CH.

As another specific example let ΣRN=16 and n=3, then EQ)n)=16/4=4 remainder 0 and EQ(n)=0 which indicates that the set of symbols to be shown beneath the payline upon a losing game as selected from the set of equations P(0) above is P(0)=/CH+/CH+(/CH AND /Bar AND /5Bar).

Symbols are referred to in computer memory as integers: as an example let a "Cherry"=0, a "Bar"=1, a "5Bar"=2, a "SP=3 and a "blank"=4, count of distinct symbol types (CntSym) is equal to 5 as illustrated in FIG. 14. A symbol to display beneath the payline as the result of a game (Sym#) may be selected by means of the selection criterion: Sym#=MOD(ΣRN/CntSym) if it is not specifically designated by a payline equation. Equation P(0)0 will be solved as a illustration of determining symbols to show beneath the payline as results of a losing game where ΣRN=17. Reel 1 should be stopped at a position which indicates "/CH" which is any symbol with exception of a "Cherry" beneath the payline, solving for Sym#=MOD(17/5)=3 remainder 2 which indicates a "5Bar" is to be selected to show beneath the payline the position of upon the reel strip which SymPos =5+(MOD(17/2))(8)=5+(1)(8)=13 which results in a stop position of Reel 1 at reel strip position 13. Reel 1 and reel 2 at this point indicate to a player "5Bar", "5Bar" and reel 3 continues to rotate. Stop position for reel 3 is solved by (/CH AND /Bar AND /5Bar) which indicates that the symbol beneath the payline at the selected stop position should not be 0, 1 or 2. A symbol is chosen by adding a constant to the symbol number previously determined (Sym#=2); select the constant as 1 which yields Sym#=2+1=3 which corresponds to "SP" which indicates that "SP" is to be selected to show beneath the payline as the stopped position of reel 3. SymPos=7+(MOD(17/2))(8)=7+(1)(8)=15 which results in a stop position of Reel 3 at reel strip position 15. The reels display "5Bar", "5Bar", "SP" to a player at conclusion of the losing game illustrated above. Note that no reel strip table exists in memory and all random reel strip stop positions are arrived at by means of solving equations.

It should be noted that this does not exclude a single symbol being present nor does it exclude the case of two symbols being one after the other (in succession with no intervening symbols). thus allowing the method of the present invention to be expanded easily by means of drawing upon known and proven theory.

It will be understood that what has been disclosed herein comprises a novel gaming system and method. Those having skill in the art to which the present invention pertains will now, as a result of the applicant's teaching herein, perceive various modifications and additions which may be made to the invention. Accordingly, all such modifications and additions are deemed to be within the scope of the invention. The spirit and scope of the invention should be limited only as set forth in the claims which follow.

What is claimed is:

1. A method of operating a game machine having a display area, said method comprising the steps of:

randomly generating a number within a first predetermined range of numbers;

filtering to determine whether said random number is within a second predetermined range of numbers, said second predetermined range of numbers being a subset of said first predetermined range of numbers; and displaying a winning symbol within said display area if said random number is within said second predetermined range of numbers.

2. The method of claim 1 further comprising the steps of:

setting a losing streak value to zero if said random number is within said second predetermined range of numbers;

incrementing said losing streak value if said random number is not within said second predetermined range of numbers;

displaying said losing streak value within said display area; and displaying a winning symbol within said display area if said losing streak value is equal to a predetermined losing streak value.

3. The method of claim 1 further comprising the step of:

displaying a losing symbol within said display area if said random number is not within said second predetermined range of numbers.

4. The method of claim 1 wherein said first predetermined range of numbers is randomly generated.

5. The method of claim 1 wherein said second predetermined range of numbers is randomly generated.

6. The method of claim 1 further comprising the step of:

permitting a game player to determine the location of the second range of predetermined numbers within the first range of predetermined numbers.

7. A method of operating a game machine having a display area, said method comprising the steps of:

setting a count of randomly generated numbers to zero at the beginning of a gaming period;

randomly generating a number within a first predetermined range of numbers;

incrementing said count after generating said random number;

determining whether said random number is within a second predetermined range of numbers, said second predetermined range of numbers being a subset of said first predetermined range of numbers;

determining whether said count is equal to a predetermined count limit;

displaying a winning symbol within said display area if said random number is within said second predetermined range of numbers and said count is equal to said predetermined count limit; and permitting a game player to increase a wager if said random number is within said second predetermined range of numbers and said count is less than said predetermined count limit.

8. The method of claim 7 further comprising the steps of:

setting a losing streak value to zero if said random number is within said second predetermined range of numbers;

incrementing said losing streak value if said random number is not within said second predetermined range of numbers;

displaying said losing streak value within said display area; and displaying a winning symbol within said display area if said losing streak value is equal to a predetermined losing streak value.

9. The method of claim 7 further comprising the step of:

displaying a losing symbol within said display area if said random number is not within said second predetermined range of numbers and said count is equal to a predetermined count limit.

10. The method of claim 7 wherein said first predetermined range of numbers is randomly generated.

11. The method of claim 7 wherein said second predetermined range of numbers is randomly generated.

12. The method of claim 7 further comprising the step of:

permitting said game player to determine the location of the second range of predetermined numbers within the first range of predetermined numbers.

13. A method of operating a game machine having a display area, said method comprising the steps of:

setting a count of randomly generated numbers to zero at the beginning of a gaming period;

determining the amount of a wager made by a game player;

randomly generating a number within a first predetermined range of numbers;

incrementing said count after generating said random number;

determining whether said random number is within a second predetermined range of numbers, said second predetermined range of numbers being a subset of said first predetermined range of numbers;

incrementing a hit value if said random number is within said second predetermined range of numbers;

determining whether said count is equal to a predetermined count limit; and displaying a winning symbol within said display area if said random number is within said second predetermined range of numbers and said count is equal to said predetermined count limit, said winning symbol being derived from said hit value and said wager amount.

14. The method of claim 13 further including the step of:

determining a payoff to said game player, said payoff being derived from said hit value and said wager amount.

15. The method of claim 13 further comprising the steps of:

setting a losing streak value to zero if said random number is within said second predetermined range of numbers;

incrementing said losing streak value if said random number is not within said second predetermined range of numbers;

displaying said losing streak value within said display area; and displaying a winning symbol within said display area if said losing streak value is equal to a predetermined losing streak value.

16. The method of claim 13 further comprising the step of:

displaying a losing symbol within said display area if said random number is not within said second predetermined range of numbers and said count is equal to a predetermined count limit.

17. The method of claim 13 wherein said first predetermined range of numbers is randomly generated.

18. The method of claim 13 wherein said second predetermined range of numbers is randomly generated.

19. The method of claim 13 further comprising the step of:

permitting said game player to determine the location of the second range of predetermined numbers within the first range of predetermined numbers.

20. A game apparatus comprising:

a random number circuit for generating a random number signal within a first bandwidth;

a digital filter circuit electrically connected to said random number circuit such that said digital filter circuit passes said random number signal if said random number signal is within a second bandwidth; and an output device electrically connected to said digital filter circuit such that said output device displays a winning symbol in response to said digital filter circuit passing said random number signal.

21. The game apparatus of claim 20 wherein said first bandwidth represents a first range of numbers.

22. The game apparatus of claim 21 wherein said second bandwidth represents a second range of numbers, said second range of numbers being a subset of said first range of numbers.

23. The game apparatus of claim 20 wherein said output device displays a losing symbol if said digital filter circuit has not passed any random number signals at the conclusion of a gaming period.

24. The game apparatus of claim 21 further comprising:

a losing streak circuit electrically connected to said digital filter circuit such that said losing streak circuit sets a losing streak value to zero if said digital filter circuit passes said random number signal and increments said losing streak value if said digital filter circuit does not pass said random number signal; and said output device electrically connected to said losing streak circuit such that said output device displays a second winning symbol if said losing streak value is equal to a predetermined losing streak value.

25. The game apparatus of claim 24 wherein said output device displays said losing streak value during a gaming period.

26. The game apparatus of claim 20 wherein said first bandwidth is randomly generated.

27. The game apparatus of claim 20 wherein said second bandwidth is randomly generated.

28. The game apparatus of claim 20 further including means for permitting a game player to determine the range of said second bandwidth during a gaming period.

29. A game apparatus comprising:

a random number circuit for generating a plurality of random number signals within a first bandwidth;

a counter circuit electrically connected to said random number circuit such that said counter circuit increments a count value each time said random number circuit generates one of said plurality of random number signals;

a digital filter circuit electrically connected to said random number circuit such that said digital filter circuit passes a portion of said plurality of random number signals that are within a second bandwidth; and an output device electrically connected to said digital filter circuit such that said output device displays a winning symbol in response to said count value being equal to a predetermined count value and said digital filter circuit passing said portion of said plurality of random number signals.

30. The game apparatus of claim 29 wherein said first bandwidth represents a first range of numbers.

31. The game apparatus of claim 30 wherein said second bandwidth represents a second range of numbers, said second range of numbers being a subset of said first range of numbers.

32. The game apparatus of claim 30 wherein said output device displays a losing symbol if said digital filter circuit has not passed said portion of said plurality of random number signals when said count value is equal to said predetermined count value.

33. The game apparatus of claim 29 further comprising:

a losing streak circuit electrically connected to said digital filter circuit such that said losing streak circuit sets a losing streak value to zero if said digital filter circuit passes at least one random number signal and increments said losing streak value if said digital filter circuit does not pass any random number signals; and said output device electrically connected to said losing streak circuit such that said output device displays a second winning symbol if said losing streak value is equal to a predetermined losing streak value.

34. The game apparatus of claim 33 wherein said output device displays said losing streak value during a gaming period.

35. The game apparatus of claim 29 wherein said first bandwidth is randomly generated.

36. The game apparatus of claim 29 wherein said second bandwidth is randomly generated.

37. The game apparatus of claim 29 further including means for permitting a game player to determine the range of said second bandwidth during a gaming period.

38. The game apparatus of claim 29 further including means for permitting a game player to increase a wager if said digital filter circuit passes at least one of said plurality of random number signals before said count value is equal to said predetermined count value.

39. A game apparatus having a display area, said game apparatus comprising:

means for randomly generating a number within a first predetermined range of numbers;

means for filtering to determine whether said random number is within a second predetermined range of numbers, said second predetermined range of numbers being a subset of said first predetermined range of numbers; and means for displaying a winning symbol within said display area if said random number is within said second predetermined range of numbers.

40. The game apparatus of claim 39 further comprising:

means for setting a losing streak value to zero if said random number is within said second predetermined range of numbers;

means for incrementing said losing streak value if said random number is not within said second predetermined range of numbers;

means for displaying said losing streak value within said display area; and means for displaying a winning symbol within said display area if said losing streak value is equal to a predetermined losing streak value.

41. A game apparatus having a display area, said game apparatus comprising:

means for setting a count of randomly generated numbers to zero at the beginning of a gaming period;

means for determining the amount of a wager made by a game player;

means for randomly generating a number within a first predetermined range of numbers;

means for incrementing said count after generating said random numer;

means for determining whether said random number is within a second predetermined range of numbers, said second predetermined range of numbers being a subset of said first predetermined range of numbers;

means for incrementing a hit value if said random number is within said second predetermined range of numbers;

means for determining whether said count is equal to a predetermined count limit; and means for displaying a winning symbol within said display area if said random number is within said second predetermined range of numbers and said count is equal to said predetermined count limit, said winning symbol being derived from said hit value and said wager amount.

42. The apparatus of claim 41 further comprising:

means for determining a payoff to said game player, said payoff being derived from said hit value and said wager amount.

43. The apparatus of claim 41 further comprising:

means for setting a losing streak value to zero if said random number is within said second predetermined range of numbers;

means for incrementing said losing streak value if said random number is not within said second predetermined range of numbers;

means for displaying said losing streak value within said display area; and means for displaying a winning symbol within said display area if said losing streak value is equal to a predetermined losing streak value.

44. A method of selecting a reel position to display a game outcome to a player, said method comprising the steps of:

providing a plurality of equations describing the position of a symbol;

selecting a reel position in a manner based at least in part upon solution of at least one of said equations.

* * * * *